US010047546B2

(12) United States Patent
Brunner

(10) Patent No.: US 10,047,546 B2
(45) Date of Patent: Aug. 14, 2018

(54) CABINET OF STORAGE UNITS

(71) Applicant: KETER PLASTIC LTD, Herzlyia (IL)

(72) Inventor: Yaron Brunner, Timrat (IL)

(73) Assignee: KETER PLASTIC LTD., Herzelyia (IL)

( * ) Notice: Subject to any disclaimer, the term of this patent is extended or adjusted under 35 U.S.C. 154(b) by 0 days.

(21) Appl. No.: 14/767,554

(22) PCT Filed: Feb. 13, 2014

(86) PCT No.: PCT/IL2014/050158
§ 371 (c)(1),
(2) Date: Aug. 12, 2015

(87) PCT Pub. No.: WO2014/125488
PCT Pub. Date: Aug. 21, 2014

(65) Prior Publication Data

US 2015/0376917 A1 Dec. 31, 2015

Related U.S. Application Data

(60) Provisional application No. 61/764,733, filed on Feb. 14, 2013.

(51) Int. Cl.
*E05B 65/46* (2017.01)
*A47B 67/04* (2006.01)
(Continued)

(52) U.S. Cl.
CPC ..... *E05B 65/463* (2013.01); *A47B 47/0091* (2013.01); *A47B 67/04* (2013.01);
(Continued)

(58) Field of Classification Search
CPC .... E05B 65/462; E05B 65/463; E05B 65/464; A47B 67/04; A47B 88/02; A47B 88/04;
(Continued)

(56) References Cited

U.S. PATENT DOCUMENTS 506,147 A * 10/1893 Almack ..... E05B 65/462 312/215
549,853 A * 11/1895 Merz ..... A47B 47/04 312/107.5
(Continued)

FOREIGN PATENT DOCUMENTS

CH 418169 7/1966
CN 2926424 Y * 7/2007 ..... E05B 65/46
(Continued)

OTHER PUBLICATIONS

International Search Report and Written Opinion for International Application No. PCT/IL2014/050158 dated Oct. 17, 2014.

*Primary Examiner* — Andrew M Roersma
(74) *Attorney, Agent, or Firm* — Dorsey & Whitney LLP

(57) ABSTRACT

A cabinet (1) comprising: a housing (10); two or more storage units (30, 50), each accommodated within the housing (10) and displaceable between a closed position in which a majority of the storage unit (30, 50) is disposed within the housing (10) and an open position in which the storage unit (30, 50) projects from the housing (10) to an extent greater than in said closed position; and a blocking mechanism (70) comprising two or more blocking members (71*b*, 71*c*), each associated with its corresponding storage unit (30, 50) and configured for selectively arresting said corresponding storage unit (30, 50) in its closed position; the blocking mechanism (70) being displaceable between an unblocked state in which each one of the storage units (30, 50) is free to be displaced from its closed position to its open position and a blocked state in which at least one and no more than all but one of the storage units (30, 50) are arrested in their closed position by their corresponding blocking members (71*b*, 71*c*). The association between the blocking mechanism (70) and the storage units (30, 50) is such that, when said blocking mechanism (70) is in its unblocked position, dis-
(Continued)

placement of one of said storage units (30, 50) from its closed position to its open position induces displacement of the blocking mechanism (70) from its unblocked state to its blocked state.

6 Claims, 32 Drawing Sheets

(51) Int. Cl.

| | |
|---|---|
| ***A47B 87/02*** | (2006.01) |
| ***B25H 3/02*** | (2006.01) |
| ***A47B 47/00*** | (2006.01) |
| ***A47B 88/70*** | (2017.01) |
| ***A47B 88/40*** | (2017.01) |
| ***E05B 65/463*** | (2017.01) |
| ***E05B 65/462*** | (2017.01) |

(52) U.S. Cl.
CPC ..... *A47B 87/0276* (2013.01); *A47B 87/0284* (2013.01); *A47B 87/0292* (2013.01); *A47B 88/40* (2017.01); *A47B 88/70* (2017.01); *B25H 3/028* (2013.01); *E05B 65/462* (2013.01)

(58) Field of Classification Search
CPC ..... A47B 2097/008; A47B 2210/0086; A47B 2210/0089; B25H 3/028
See application file for complete search history.

(56) References Cited

U.S. PATENT DOCUMENTS

| | | | | | |
|---|---|---|---|---|---|
| 996,934 | A * | 7/1911 | Loehler | E05B 65/464 | 312/221 |
| 3,404,929 | A * | 10/1968 | Wright | E05B 65/463 | 312/216 |
| 3,888,558 | A * | 6/1975 | Himsl | E05B 65/463 | 312/216 |
| 4,239,309 | A * | 12/1980 | De Fouw | E05B 65/463 | 312/216 |
| 4,533,336 | A * | 8/1985 | Dixon | A63H 17/26 | 312/219 |
| 4,732,434 | A * | 3/1988 | Hartrum | E05B 65/464 | 312/217 |
| 4,775,199 | A * | 10/1988 | Lanius | B25H 3/028 | 312/216 |
| 4,865,404 | A * | 9/1989 | Harper | E05B 65/463 | 312/219 |
| 5,016,948 | A * | 5/1991 | Welch | A47B 88/0451 | 211/126.15 |
| 5,333,949 | A * | 8/1994 | McGregor | E05B 65/464 | 312/221 |
| 5,335,986 | A * | 8/1994 | Hartrum | E05B 65/463 | 312/217 |
| 5,387,032 | A * | 2/1995 | Reisbeck | E05B 65/463 | 312/217 |
| 5,671,985 | A * | 9/1997 | Grieser | E05B 65/463 | 312/217 |
| 6,185,103 | B1 * | 2/2001 | Yamada | G11B 33/124 | 292/300 |
| 6,722,749 | B1 * | 4/2004 | Pagac | E05B 65/463 | 312/218 |
| 6,746,091 | B2 * | 6/2004 | Friar | A61G 12/001 | 312/218 |
| 6,896,342 | B1 * | 5/2005 | Cheng | E05B 65/463 | 312/217 |
| 7,823,991 | B2 * | 11/2010 | Purdy | A47B 67/04 | 206/373 |
| 8,740,319 | B1 * | 6/2014 | Davis | E05B 65/462 | 312/216 |
| 2004/0108795 | A1 * | 6/2004 | Meek, Jr. | E05B 47/0002 | 312/218 |
| 2005/0168115 | A1 * | 8/2005 | Moon | A47B 47/042 | 312/257.1 |
| 2008/0054768 | A1 * | 3/2008 | Lin | E05B 65/463 | 312/221 |
| 2011/0031859 | A1 * | 2/2011 | Briggs | E05B 65/462 | 312/333 |
| 2011/0121695 | A1 * | 5/2011 | Purdy | A47B 67/04 | 312/222 |

FOREIGN PATENT DOCUMENTS

| | | | | |
|---|---|---|---|---|
| CN | 201661152 U * | 12/2010 | E05B 65/46 | |
| DE | 3633256 A1 * | 3/1988 | A47B 88/16 | |
| DE | 20014623 | 12/2000 | | |
| DE | 102011050823 A1 * | 12/2012 | | |
| EP | 0442521 A2 * | 2/1991 | E05B 65/46 | |
| EP | 0442521 | 8/1991 | | |
| EP | 1498560 | 1/2005 | | |
| EP | 2537641 | 12/2012 | | |
| EP | 2630320 B1 * | 12/2014 | A47B 88/43 | |
| FR | 2240643 | 3/1975 | | |
| GB | 2108564 A * | 5/1983 | E05B 65/46 | |
| NL | 9001979 A * | 4/1992 | A47B 96/16 | |
| WO | WO 9945221 | 9/1999 | | |
| WO | WO 2007/139410 | 12/2007 | | |

* cited by examiner

CABINET OF STORAGE UNITS

TECHNOLOGICAL FIELD

The presently disclosed subject matter relates to cabinets having at least one storage unit.

BACKGROUND

Storage cabinets are used to store parts, such as nuts, bolts, and nails, and tools, such as screw drivers, wrenches, and utility knives. These cabinets typically include storage units in the form of drawers, having a predetermined arrangement and size. The drawers are usually arranged from upper side to lower side of the cabinet. The drawers can slide horizontally into and out of the cabinet. Sliding drawers are commonly built into tool cabinets, kitchen cabinets, desks, dining room cabinetry, office furniture, and the like to provide more convenient access to storage space therein.

General Description

According to one aspect of the presently disclosed subject matter, there is provided a cabinet comprising:

a housing;

two or more storage units, each accommodated within the housing and displaceable between a closed position in which the majority of the storage unit is disposed within the housing and an open position in which the storage unit projects from the housing to an extent greater than in said closed position; and a blocking mechanism comprising two or more blocking members, each associated with its corresponding storage unit and configured for selectively arresting said corresponding storage unit in its closed position; the blocking mechanism being displaceable between an unblocked state in which each one of the storage units is free to be displaced from its closed position to its open position and a blocked state in which at least one and no more than all but one of the storage units are arrested in their closed position by their corresponding blocking members;

the association between the blocking mechanism and the storage units is such that, when said blocking mechanism is in its unblocked position, displacement of one of said storage units from its closed position to its open position induces displacement of the blocking mechanism from its unblocked state to its blocked state.

The term "majority of the storage unit" may be interpreted with respect to any one of the following: length of the storage unit measured along the direction of its displacement with respect to the housing, nominal dimensions of the storage unit, volume of the storage unit and weight of the storage unit.

The blocking mechanism is configured for preventing more than one storage unit being in their open position at the same time, thereby reducing the probability of tipping over of the cabinet, for example, due to shifting of the center of gravity thereof.

According to one example, at least one of the storage units is a drawer.

According to another example, at least one of the storage units is an assortment box.

The association between the blocking mechanism and the storage units can also be such that displacement of one storage unit from its open position to its closed position induces displacement of the blocking mechanism from its blocked state to its unblocked state.

The storage units can comprise a restricting arrangement associated with the blocking mechanism so that in the blocked state of the blocking mechanism, the blocking mechanism obstructs the restricting arrangement, to thereby prevent displacement thereof from their closed position to their open position. In particular, the restricting arrangement can be constituted by restricting portions of the storage units. In the blocked state, the blocking members are aligned with the corresponding restricting portions of the storage units so that during an attempt to displace a blocked storage unit from its closed position to its open position, the blocking members are configured to engage corresponding restricting portions of the restricting arrangement to thereby obstruct of the storage units and prevent their above displacement.

The cabinet can further comprise a following arrangement associated, on the one hand, with the blocking mechanism, and on the other hand with the storage units. The following arrangement is associated with said storage units such that displacement of one storage unit from its closed position to its open position entails displacement of the following arrangement from its inoperative state to its operative state. The following arrangement is associated with said blocking mechanism such that displacement of the following arrangement from its inoperative state to its operative state entails displacement of the blocking mechanism from its unblocked state to its blocked state. Thus, displacement of a single storage unit from its closed position to its open position entails displacement of the blocking mechanism from the unblocked state to the blocked state.

The following arrangement can comprise two or more following members configured for association with each of the two or more storage units respectively. According to a particular design, the following arrangement can be a part of the blocking mechanism, i.e. the following members can be integrally formed with the blocking mechanism.

Each of the storage units can be configured with a guiding portion associated with its corresponding following member, so that during the displacement of the storage unit between its closed position and its open position, the corresponding following member slidingly engages its corresponding guiding portion (e.g. cam and following configuration), thereby changing the operative state of the following arrangement between its inoperative state and its operative state, respectively.

During the engagement of the following member with its corresponding guiding portion, the following member can rest on the guiding portion and slide along its length.

The blocking mechanism can be in the form of a single-molded member. In particular, both the blocking members and the following members can be integrally formed therewith and constitute portions of the single-molded member.

Each blocking member and following member can be constituted by a single blocking-following member. In particular, a first portion (e.g. a side surface) of the blocking-following member can constitute the blocking member and a second portion (e.g. a bottom end) of the blocking-following member can constitute the following member.

The storage units can be arranged within the cabinet along a longitudinal axis, and the blocking mechanism can have an elongated shape and can extend along said longitudinal axis.

According to one example, the longitudinal axis can be a vertical axis along which the blocking mechanism is configured to be displaced between its blocked state and its unblocked state.

In particular, the blocking mechanism can be displaced in the upward direction, when displaced from its unblocked state to its blocked state, and in the downward direction, when displaced from its blocked state to its unblocked state.

According to another example, the longitudinal axis can be a horizontal axis along which the blocking mechanism is configured to be displaced between its blocked state and its unblocked state.

The blocking mechanism can be normally urged into its unblocked state by virtue of gravity forces.

The blocking mechanism can further comprise a biasing arrangement configured for biasing the blocking mechanism from its blocked state towards its unblocked state.

The biasing arrangement can be constituted by a compression spring.

The biasing arrangement can be disposed at the uppermost end of the blocking mechanism.

Each guiding portion can be provided with a ramp portion configured to displace the corresponding following member while sliding thereon, thereby displacing the following arrangement towards its operative state, and consequentially, displacing the blocking mechanism towards its blocked state.

The blocking-following member can be sized for passing between the corresponding restricting and guiding portions during the displacement of the storage unit between its closed position and its open position.

The blocking-following member can have a predetermined width which, during the displacement of the storage unit from its closed to its open position, allows the blocking-following member to pass by the corresponding restricting portion before engaging a lower end of the ramp portion, so as to allow the blocking-following member to be displaced in the upper direction when sliding on the ramp portion.

Each of the storage units can have a cavity defined by a base section, a front wall, a first sidewall and a second sidewall, each having a first and a second exterior surface, respectively. The guiding portion of each storage unit can protrude from one of the first and the second exterior surfaces.

The restricting portion of each storage unit can protrude from one of the first and the second exterior surfaces.

At least one of the storage units can further have an intermediate position in which the storage unit projects from the housing to an extent greater than in the closed position and smaller than in the open position. In the intermediate position, the blocking mechanism is in its unblocked state, thereby allowing more than one storage unit to be displaced to its open position.

In the closed position of the storage unit, a lower end of the ramp portion can be spaced from the blocking-following member along the guiding portion to an intermediate distance, so that the storage unit can be displaced from its closed position to its intermediate position without displacing the blocking mechanism to its blocked state.

The intermediate distance can be such that when all the storage units are in their intermediate position, there is no danger of tipping over of the cabinet.

Each of the blocking members can protrude out of the blocking mechanism towards the respective storage unit.

The cabinet can have a front wall. The blocking members can be disposed along a first plane and the restricting portions can be disposed along a second plane, such that the first plane is closer to the front wall than the second plane.

Each of the following members can protrude out of the blocking mechanism towards the respective storage unit.

The following members can be disposed along the first plane.

Each storage unit can include at least one slide mechanism configured for mounting the storage unit to the housing and facilitating the displacement of the storage unit between its closed position and its open position.

For example, each storage unit can include two slide mechanisms, connected to the first and the second sidewalls of the storage unit, respectively.

The guiding portion can be constituted by a portion of the slide mechanism.

According to another aspect of the presently disclosed subject matter, there is provided a cabinet comprising:

a housing;

one or more storage units, each accommodated within the housing and displaceable between a closed position in which the majority of the storage unit is disposed within the housing and an open position in which the storage unit projects from the housing to an extent greater than in said closed position;

a locking mechanism configured with one or more locking members, each associated with its corresponding storage unit and configured for selectively arresting said corresponding storage unit in its closed position; the locking mechanism being displaceable between an unlocked state in which each of the storage units is free to be displaced from its closed position to its open position and a locked state in which all the storage units are arrested in their closed position by their corresponding locking members.

The locking mechanism is configured to control the ability of a user to open at least one of the storage units of the cabinet. This control can be important for different safety and/or security reasons in which a user should be prevented from opening the storage units. For example, the locking mechanism can be used for locking all the storage units at their closed position in order to prevent children from opening them and being exposed to their interior content.

It is appreciated that the above cabinet can also be provided with a blocking mechanism according to the previous aspect of the present application, thereby preventing a user from opening more than one storage unit at a time.

According to one example, the storage unit is a drawer.

According to another example, the storage unit is an assortment box.

The storage units can comprise an arresting arrangement associated with the locking mechanism so that in the locked state of the locking mechanism, the locking mechanism obstructs the arresting arrangement, to thereby prevent displacement thereof from their closed position to their open position. In particular, the arresting arrangement can be constituted by arresting portions of the storage units. In the locked state, the locking members are aligned with respective arresting portions of the storage units so that during an attempt to displace a locked storage unit from its closed position to its open position, the locking members are configured to engage corresponding arresting portions of the arresting arrangement to thereby obstruct of the storage units and prevent their above displacement.

The locking mechanism can be in the form of a single-molded member. In particular, the locking members can be integrally formed therewith and constitute portions of the single-molded member.

The storage units can be arranged within the cabinet along a longitudinal axis, and the locking mechanism can have an elongated shape and can extend along the longitudinal axis.

According to one example, the longitudinal axis can be a vertical axis along which the locking mechanism is configured to be displaced between its locked state and its unlocked state.

In particular, the locking mechanism can be displaced in the downward direction, when displaced from its locked state to its unlocked state, and in the upward direction, when displaced from its unlocked state to its locked state.

According to another example, the longitudinal axis can be a horizontal axis along which the locking mechanism is configured to be displaced between its locked state and its unlocked state.

The locking members can be sized for passing beneath the corresponding arresting portions during the displacement of the storage unit between its closed position and its open position.

Each of the storage units can have a cavity defined by a base section, a front wall, a first sidewall and a second sidewall, each having a first and a second exterior surface, respectively. The arresting portion of each storage unit can protrude from one of the first and the second exterior surfaces.

Each of the locking members can protrude out of the locking mechanism towards the respective storage unit.

The cabinet can have a front wall. The locking members can be disposed along a first plane and the arresting portions can be disposed along a second plane, such that the first plane is closer to the front wall than the second plane.

The locking mechanism can comprise an actuator for displacing the locking mechanism between its unlocked state and its locked state.

The actuator can have an actuator cavity configured to accommodate at least one finger of a user for allowing him to displace the locking mechanism between its unlocked state and its locked state.

The front wall of the cabinet can have a front edge. The front edge can have an actuator window configured for providing access to the actuator cavity.

The actuator can be configured with an indicating member, visible via an indicating window formed in the front edge of the cabinet, and configured for indicating the state in which the locking mechanism is disposed.

The indicating member can have a first portion with a first color associated with the locked state of the locking mechanism, and a second portion with a second color associated with the unlocked state of the locking mechanism. The indicating window is configured to provide visual access to one of the first and the second portions at a time, thereby indicating the state at which the locking mechanism is disposed.

The locking mechanism can further include a securing member protruding therefrom and formed with a securing recess therein. The front edge of the cabinet can be formed with an elongate opening configured for receiving therethrough the securing member. The opening in the front edge of the cabinet can be formed with a raised rim extending about the opening, and being formed with a locking recess.

The arrangement is such that the securing member can assume a first position with respect to the elongate opening, corresponding to a locked state of the locking mechanism, in which the securing recess is aligned with the locking recess of the raised rim, and a second position in with respect to the elongate opening, corresponding to a locked state of the locking mechanism, in which the securing recess is misaligned with the locking recess of the raised rim.

In the first position of the securing member, a member of a lock can be received via the locking recess and the securing recess so as to fix the locking mechanism in its locked state.

Each storage unit can include at least one slide mechanism configured for mounting the storage unit to the housing and facilitating the displacement of the storage unit between its closed position and its open position.

According to still another aspect of the presently disclosed subject matter, there is provided a modular assembly of cabinets, which are configured to be modularly stacked on each other, comprising:

a first cabinet and a second cabinet, each comprising a housing with a base section, a top section and sidewalls extending therebetween, at least one of the sidewalls being provided with at least one upper latching mechanism disposed closer to said top section and at least one lower latching mechanism disposed closer to said base section; and a support structure comprising at least one support latching mechanism, the support structure being configured to be disposed under a lowermost cabinet of the assembly, so as to provide support to the assembly;

the lower latching mechanism of the first cabinet being selectively engageable with the upper latching mechanism of the second cabinet or with the support latching mechanism, and the lower latching mechanism of the second cabinet being selectively engageable with the upper latching mechanism of the first cabinet or with the support latching mechanism, thereby allowing modular latched stacking of the first cabinet, the second cabinet and the support structure to each other.

The assembly of cabinets allows selectively stacking the cabinets on each other and on the support structure so that each one of the cabinets is latched to its neighboring cabinet by corresponding upper and lower latching mechanisms while the lowermost cabinet is latched to the support structure by the corresponding lower latching mechanism and the support latching mechanism.

The base section can have a base rim and the top section can have a top rim. The base rim of the first cabinet can correspond in shape and size to the top rim of the second cabinet, so as to allow the first cabinet to be modularly stacked on the second cabinet. The base rim of the second cabinet can correspond in shape and size to the top rim of the first cabinet, so as to allow the second cabinet to be modularly stacked on the first cabinet.

The support structure can have a top section and a base section. The top section can have a support top rim. The support top rim can correspond in shape and size to the base rim of the first cabinet and to the base rim of the second cabinet, so as to allow the first cabinet or the second cabinet to be disposed on the support structure and latched thereto.

The support structure can further have sidewalls extending between the top section and the base section. At least one of the sidewalls of the support structure can be is provided with the support latching mechanism.

The support latching mechanism can be disposed closer to the support top rim than to the base section.

The sidewalls of the support structure can include a right support sidewall, a left support sidewall and a rear support sidewall.

The support structure can be constituted by two separate support members, each including its respective right and left support sidewall.

Each support member can have at least one support connecting portion configured to engage with a corresponding cabinet connecting portion formed within the first and the second bottom for disposing the first or the second cabinet on the support structure.

The support connecting portion can be constituted by a support connecting protrusion, and the cabinet connecting portion can be constituted by a cabinet connecting recess configured to receive said support connecting protrusion.

The support structure can comprise a plurality of wheels mounted to the bottom structure thereof for allowing displacement of the assembly.

The first upper latching mechanism can be similar to the second upper latching mechanism, and the first lower latching mechanism can be similar to the second lower latching mechanism.

The walls of the first and the second cabinets can be generally coplanar with each other when the cabinets are stacked on each other.

The sidewalls of the first and the second cabinets can include a right sidewall, a left sidewall, a rear sidewall and a front sidewall. The front sidewall can have a front opening formed therein configured to receive at least one storage unit into the respective cabinet.

According to one example, the storage unit is a drawer.

According to another example, the storage unit is an assortment box.

According to one example, the lower latching mechanism can comprise a latch recess formed within the respective sidewall, configured for accommodating therein a pivotally rotatable latch member. The latch member can be configured with at least one tongue.

According to still one example, the upper latching mechanism can be a detachably attachable unit.

According to still one example, the upper latching mechanism can comprise a recess formed therein with at least one catch member configured for selectively engaging with the at least one tongue of the latch member.

According to another example, the upper latching mechanism can comprise a latch recess formed within the respective sidewall, configured for accommodating therein a pivotally rotatable latch member. The latch member can be configured with at least one tongue.

According to still another example, the lower latching mechanism can be a detachably attachable unit.

According to still another example, the lower latching mechanism can comprise a recess formed therein with at least one catch member configured for selectively engaging with the at least one tongue of the latch member.

The support latching mechanism can comprise a recess formed therein with at least one catch member configured for selectively engaging with the at least one tongue of the latch member.

The upper latching mechanism can be used as a gripping member configured to be gripped by a user for raising the respective cabinet, while the recess is used for accommodating the user's fingers therein.

The structure of the sidewalls, the top section and the base section of the first and the second cabinets can be similar to each other.

In particular, the first and the second cabinets can be similar to each other.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which.

DETAILED DESCRIPTION OF EMBODIMENTS

Figure 1A:
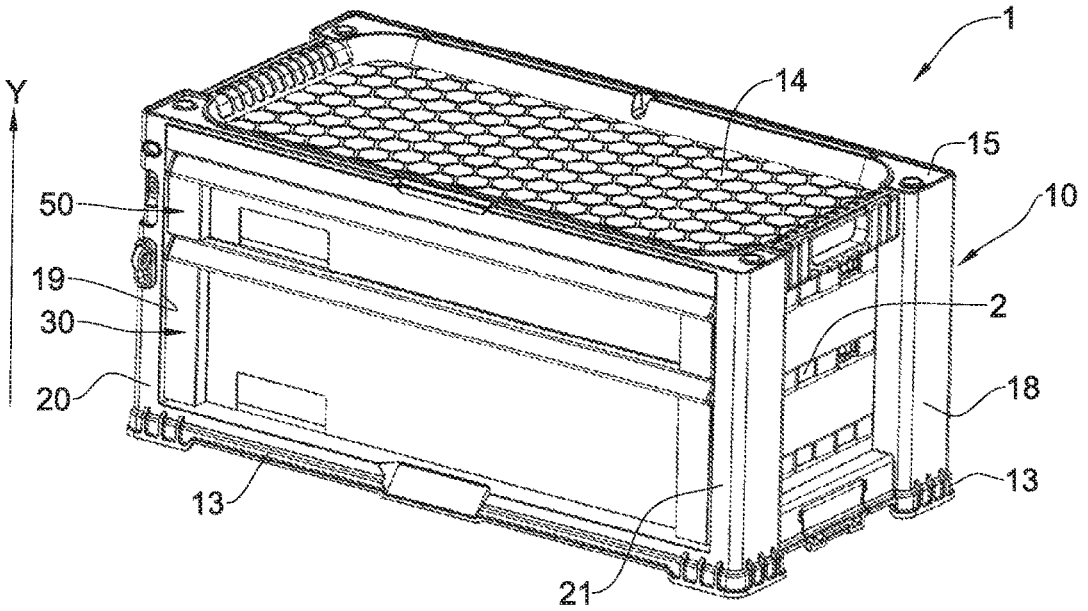
FIG. 1A is a front left isometric view of a cabinet, in accordance with one example of the presently disclosed subject matter.
Figure 1B:
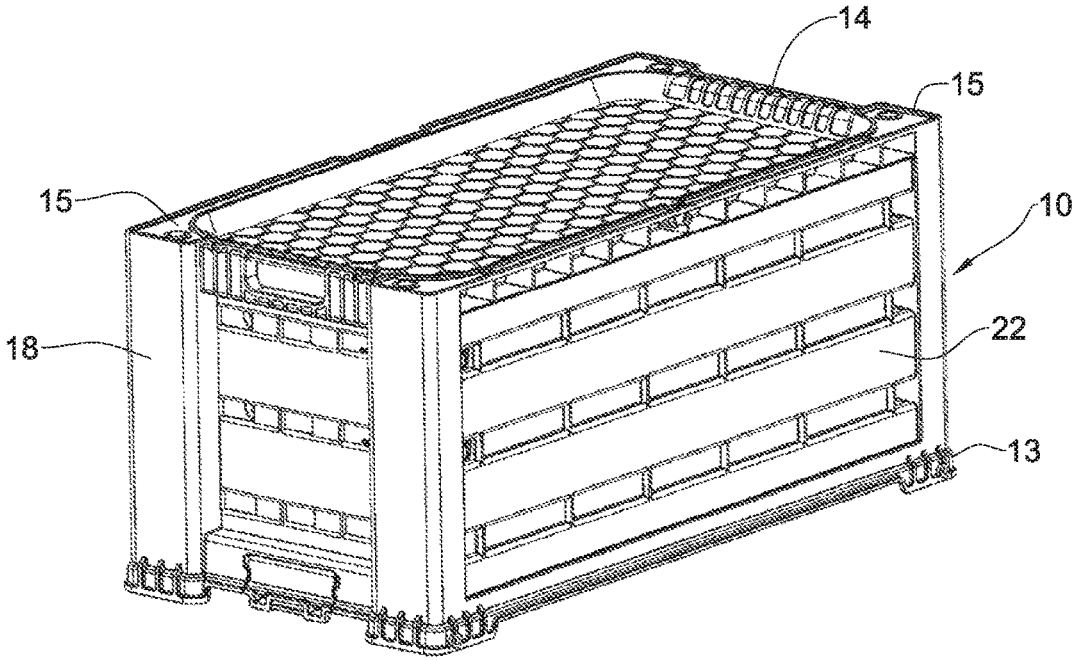
FIG. 1B is a rear left isometric view of the cabinet of FIG. 1A.

Attention is first directed to FIGS. 1A to 2E, 6A and 6B of the drawings illustrating a cabinet in accordance with one example of the presently disclosed subject matter, generally designated 1. The cabinet 1 comprises a housing 10 and two storage units in the form of drawers, including a lower drawer 30 and an upper drawer 50, each accommodated within the housing 10 and slidingly displaceable between a closed position in which the drawer is disposed within the housing 10 and an open position in which the drawer projects from the housing 10. The drawers 30 and 50 are vertically stacked within the housing 10 along a vertical axis Y. In FIGS. 1A and 1B, the drawers 30 and 50 are in their closed position, and in FIGS. 6A and 6B, the drawer 30 is in its open position and the drawer 50 is in its closed position.

Figure 2A:
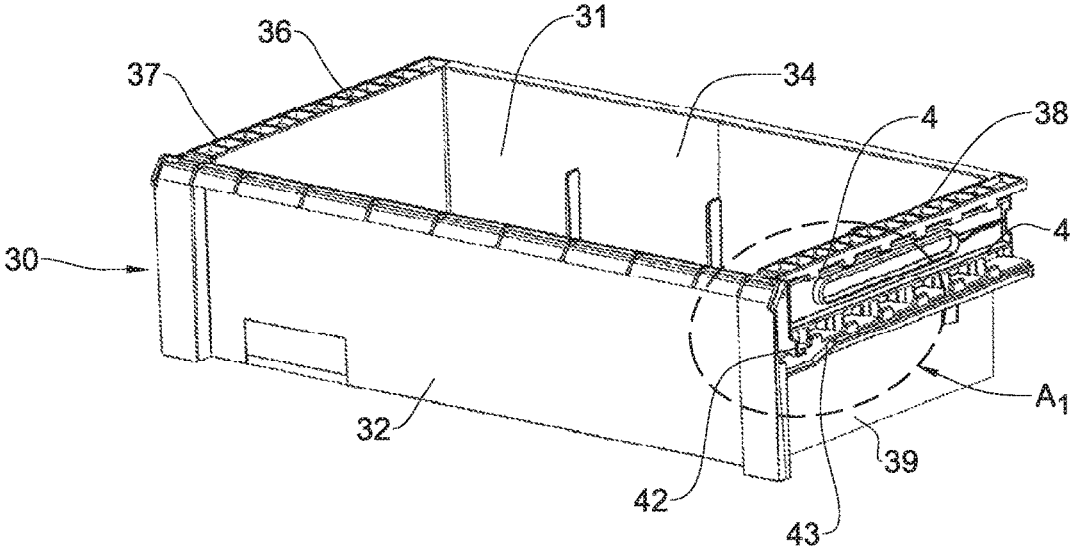
FIG. 2A is a front left isometric view of a lower drawer of the cabinet of FIG. 1A.
Figure 2B:
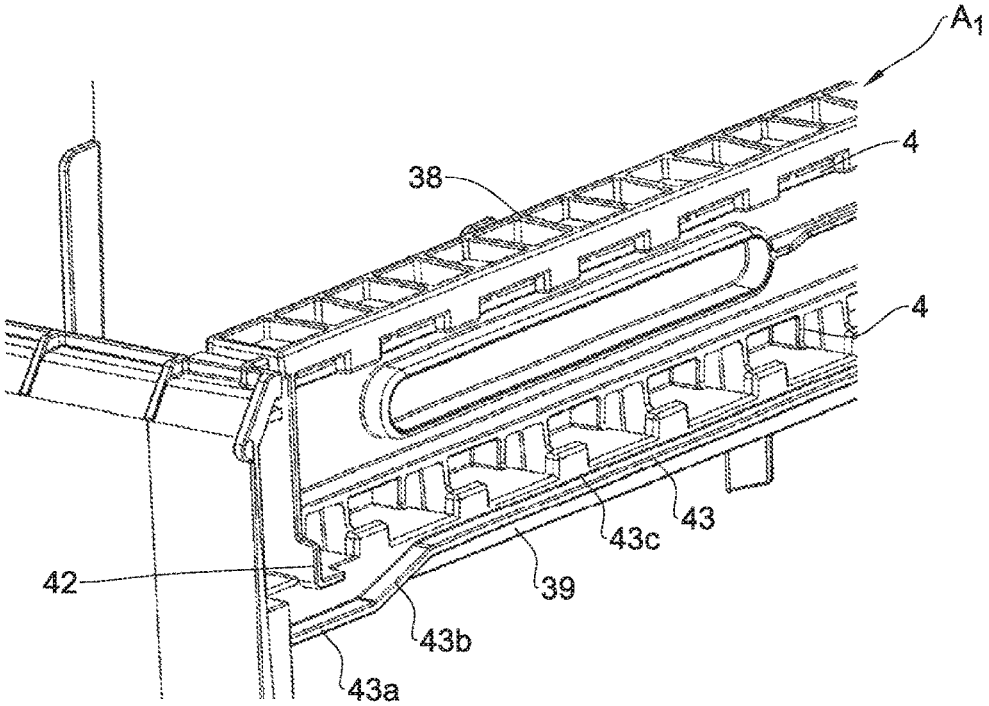
FIG. 2B is an enlarged view of a portion $A_1$ of FIG. 2A.
Figure 2C:
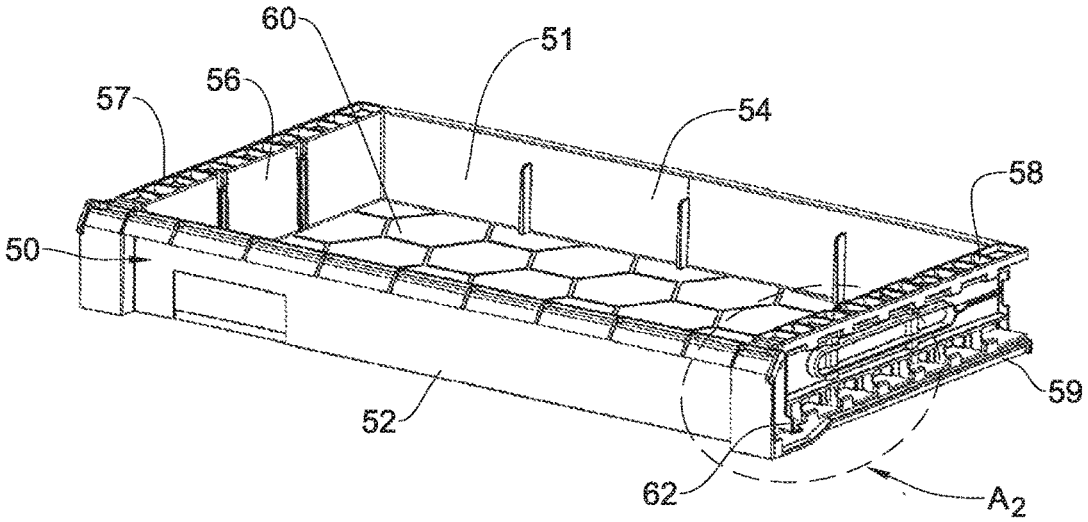
FIG. 2C is a front left isometric view of an upper drawer of the cabinet of FIG. 1A.
Figure 2D:
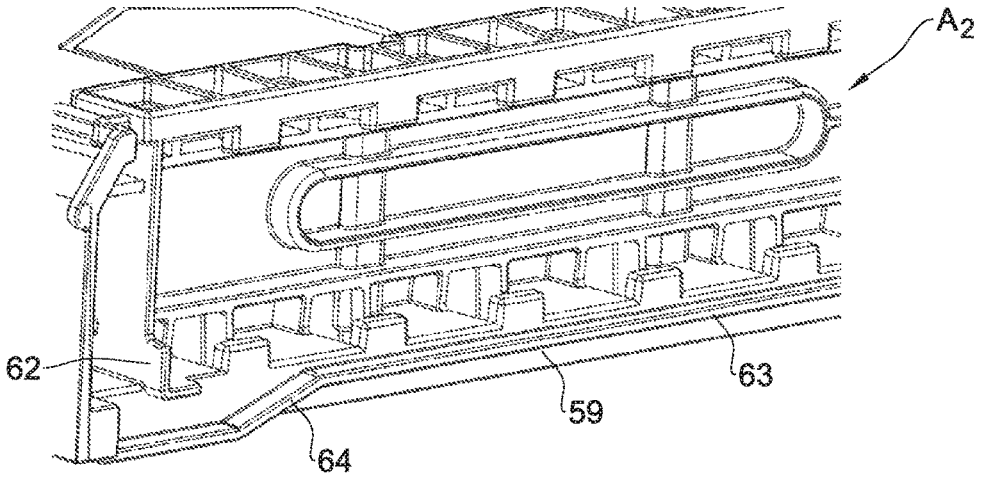
FIG. 2D is an enlarged view of a portion $A_2$ of FIG. 2A.
Figure 2E:
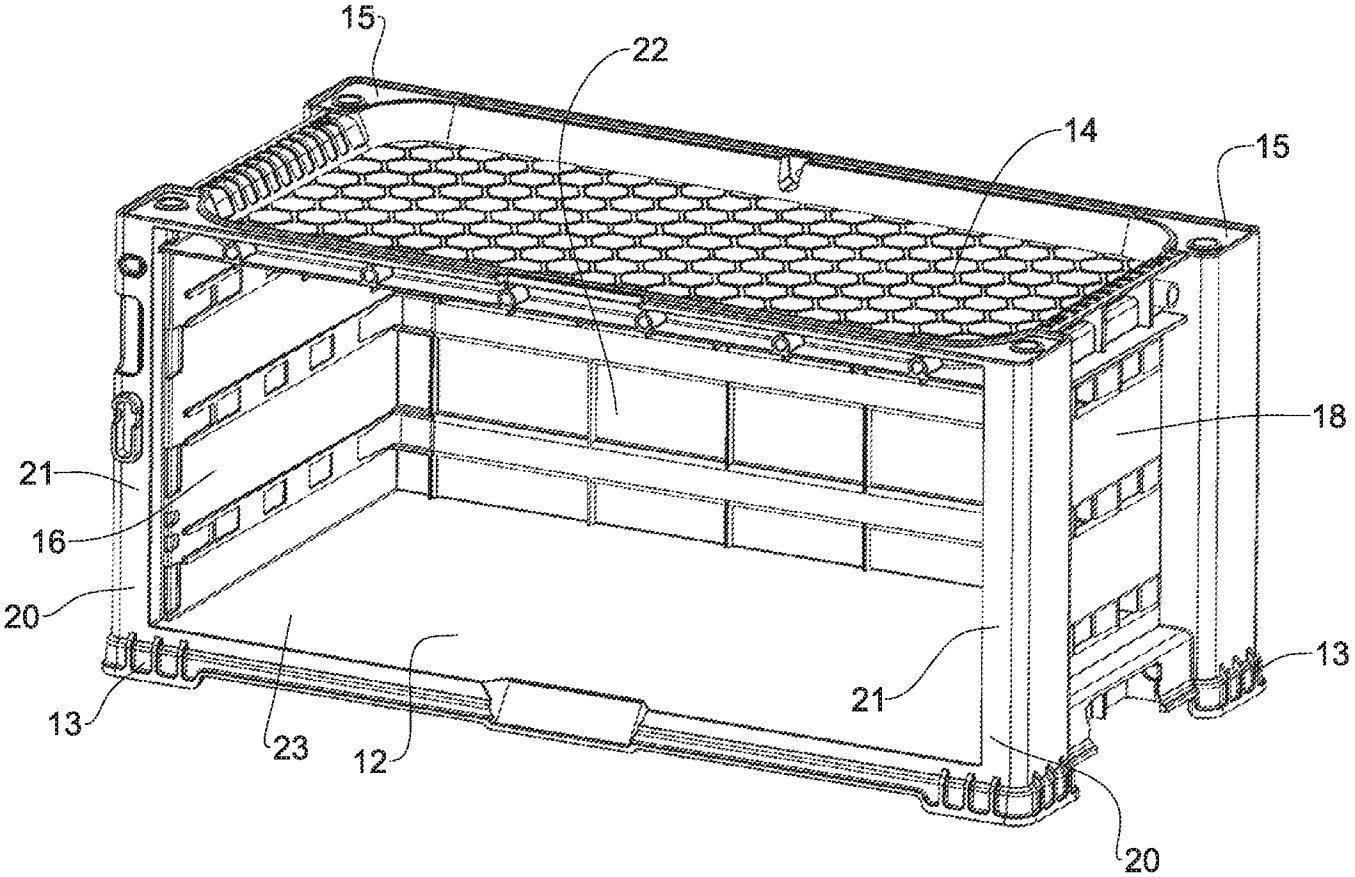
FIG. 2E is a front left isometric view of a housing of the cabinet of FIG. 1A, with the drawers being removed.

As shown in FIG. 2E, the housing 10 has a base section 12 with a base rim 13, a top section 14 with a top rim 15, a right sidewall 16, a left sidewall 18, a front frame 20 with an opening therein and a rear wall 22. The front frame 20 has a right front edge 19 and a left front edge 21. The housing 10 further has a housing cavity 23 defined by the base section 12, the top section 14, the sidewalls 16 and 18, and the walls 20 and 22. The housing cavity 23 is configured to accommodate the drawers 30 and 50 therein.

It is appreciated that the number of the drawers is not limited to two. An example of a cabinet with three drawers in presented in FIG. 18A. According to the present example, the drawer 30 occupies a space of two drawers, each having dimensions similar to those of the drawer 50.

As shown in FIG. 2A, the drawer 30 has a front wall 32, a rear wall 34, a right sidewall 36, a left sidewall 38 and a base section (not seen). The front and rear walls 32 and 34, the right and left sidewalls 36 and 38, and the base section of the drawer 30 define together a cavity 31 configured for accommodating work tools and appliances. The right sidewall 36 has a right exterior surface 37 and the left sidewall 38 has a left exterior surface 39.

As shown in FIG. 2C, the drawer 50 has a front wall 52, a rear wall 54, a right sidewall 56, a left sidewall 58 and a base section 60. The front and rear walls 52 and 54, the right and left sidewalls 56 and 58, and the base section 60 define together a cavity 51 configured for accommodating work tools and appliances. The right sidewall 56 has a right exterior surface 57 and the left sidewall 58 has a left exterior surface 59.

Each of drawers 30 and 50 is slidingly displaceable with respect to the housing 10 by two slide mechanisms interconnecting each drawer to the housing 10. Each of the two slide mechanisms is a full-extension mechanism being disposed at a respective sidewall of each drawer. The description below is made for example to a left slide mechanism 2 of the drawer 30.

Figure 6A:
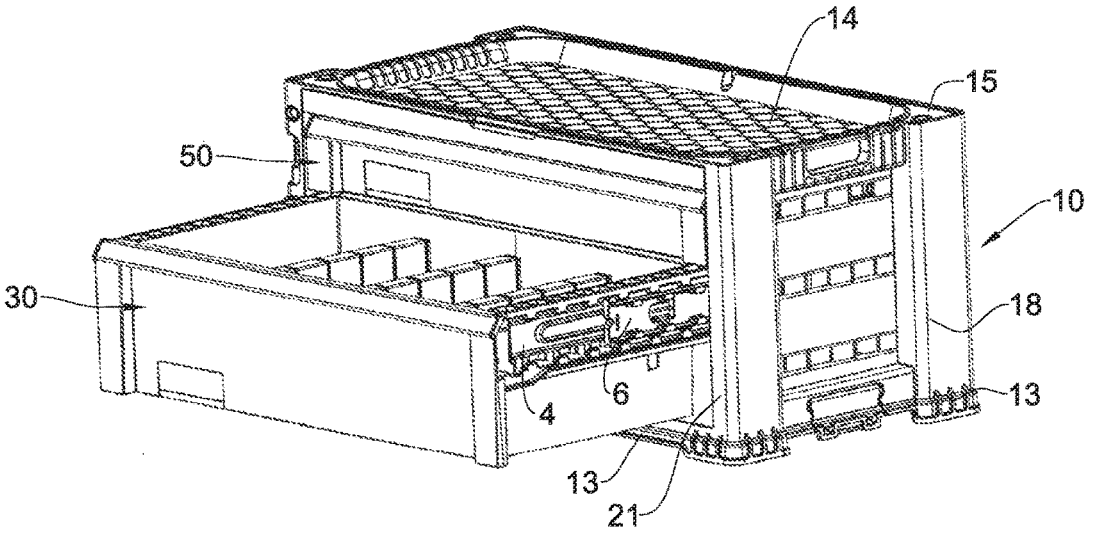
FIG. 6A is a front left isometric view of the cabinet of the FIG. 1A with one drawer shown in its open position and another drawer shown in its closed position.
Figure 6B:
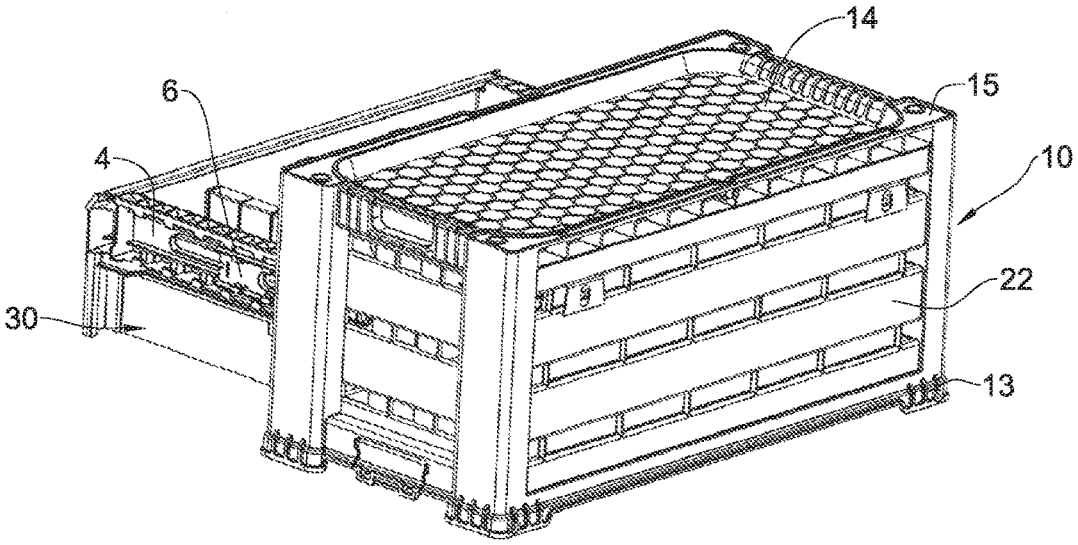
FIG. 6B is a rear left isometric view of the cabinet of the FIG. 6A.
Figure 7A:
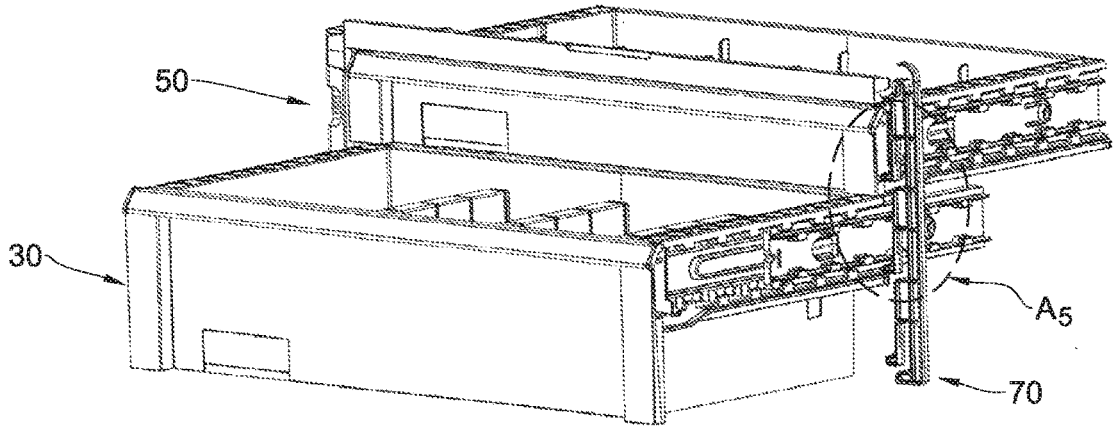
FIG. 7A is the cabinet of FIG. 6A, with its housing removed therefrom.
Figure 7B:
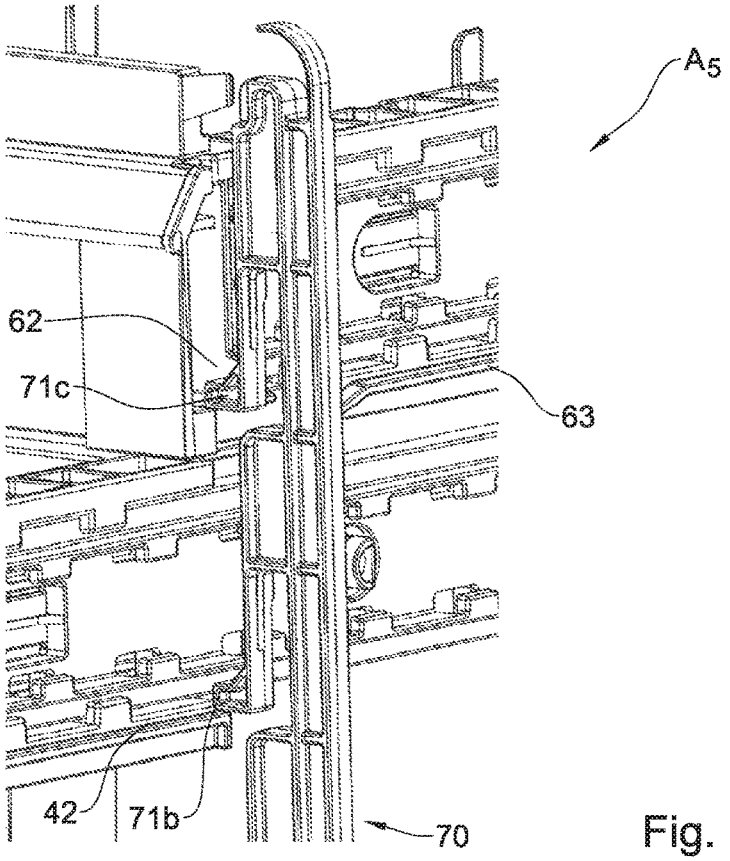
FIG. 7B is an enlarged view of a portion $A_5$ of FIG. 7A.
Figure 8A:
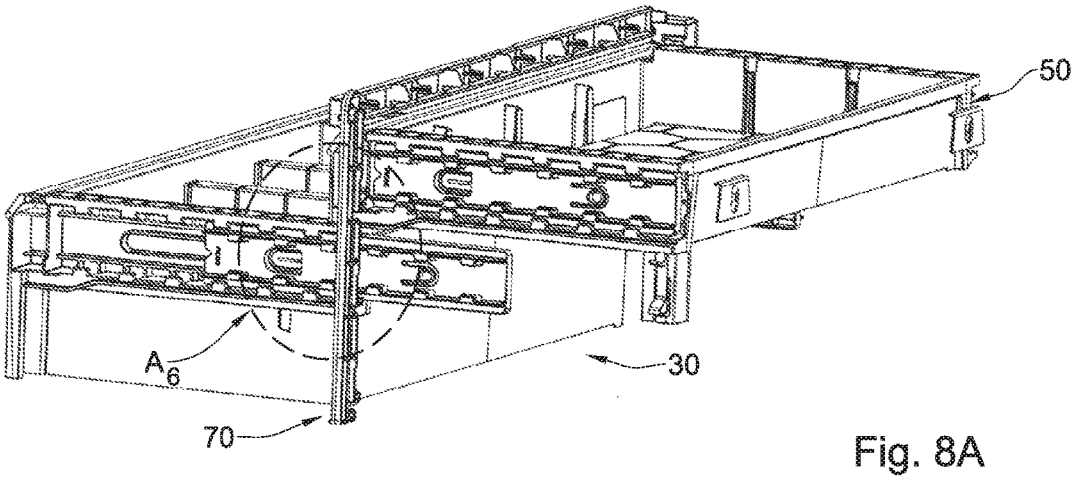
FIG. 8A is a rear left isometric view of the cabinet of FIG. 6A, with its housing removed therefrom.
Figure 8B:
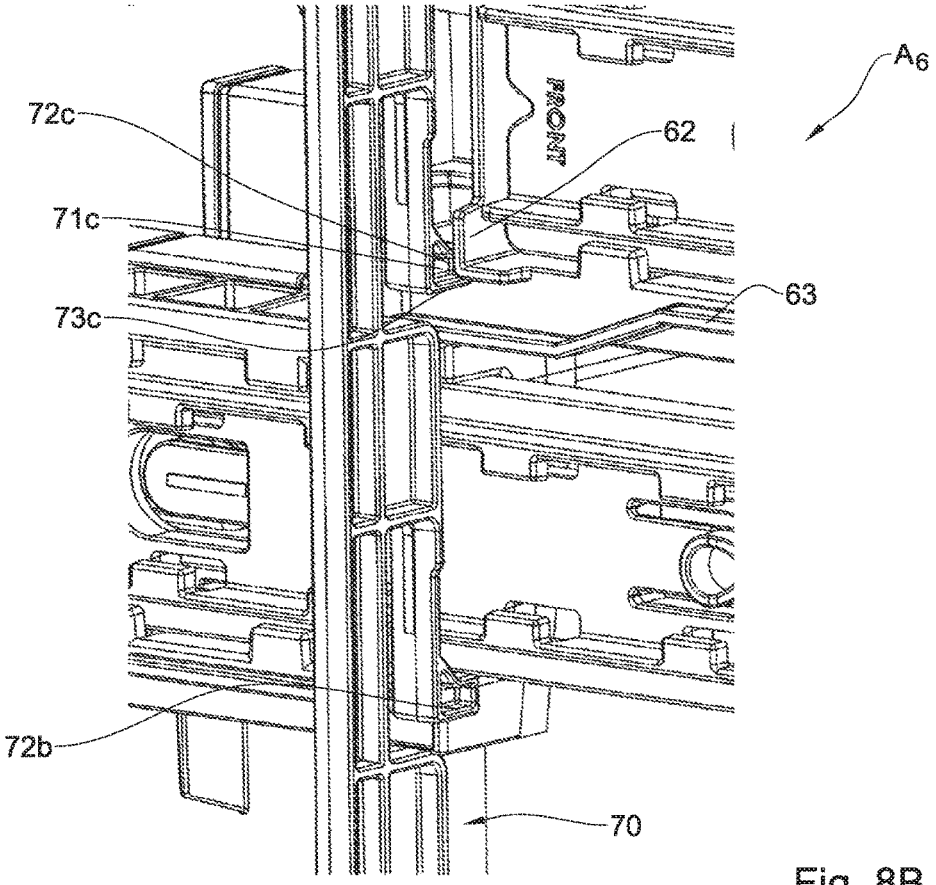
FIG. 8B is an enlarged view of a portion $A_6$ of FIG. 8A.

The slide mechanism 2 (the location of which is generally shown in FIG. 1A) has the following three members: a first member 4 (shown in FIGS. 2A and 2B) protruding from the left sidewall 38 and extending between the front wall 32 and the rear wall 34; a second member (not seen) protruding from the left sidewall 18 of the housing 10 towards the drawer 30 and extending between the front wall 20 and the rear wall 22; and an intermediate member 6 (shown in FIGS. 4A and 4B) slidingly disposed between the first and the second members. The existence of the intermediate member 6 allows the drawer 30 to fully extend out of the housing 10 in its open position (as shown for example in FIGS. 6A and 6B). As shown in FIGS. 6A and 6B, in the fully extended position of the slide mechanism 2, one half of the intermediate member 6 is engaging the first member 4, and another half of the intermediate member 6 is engaging the second member of the slide mechanism 2, thereby providing support to the drawer 30 with respect to the housing 10.

Reference is now made to FIGS. 3, 4A to 4B and 5A to 5B, in which a blocking mechanism 70 of the cabinet 1 is illustrated, in accordance with one aspect of the presently disclosed subject matter. The blocking mechanism 70 is disposed within the cabinet 1 behind the front edge 21, between the left sidewall 18 of the housing 10 and the left sidewalls 38 and 58 of the drawers 30 and 50. The blocking mechanism 70 is mechanically associated with the drawers 30 and 50 for preventing more than one drawer from being displaced to its open position at the same time.

The blocking mechanism 70 is mechanically associated with the drawers 30 and 50 such that, when these drawers are in their closed position, displacement of one drawer from its closed position to its open position induces displacement of the blocking mechanism 70 which, in turn, arrests each of the other drawers in its closed position. The structure of the blocking mechanism 70 and its way of operation will now be described.

Figure 4A:
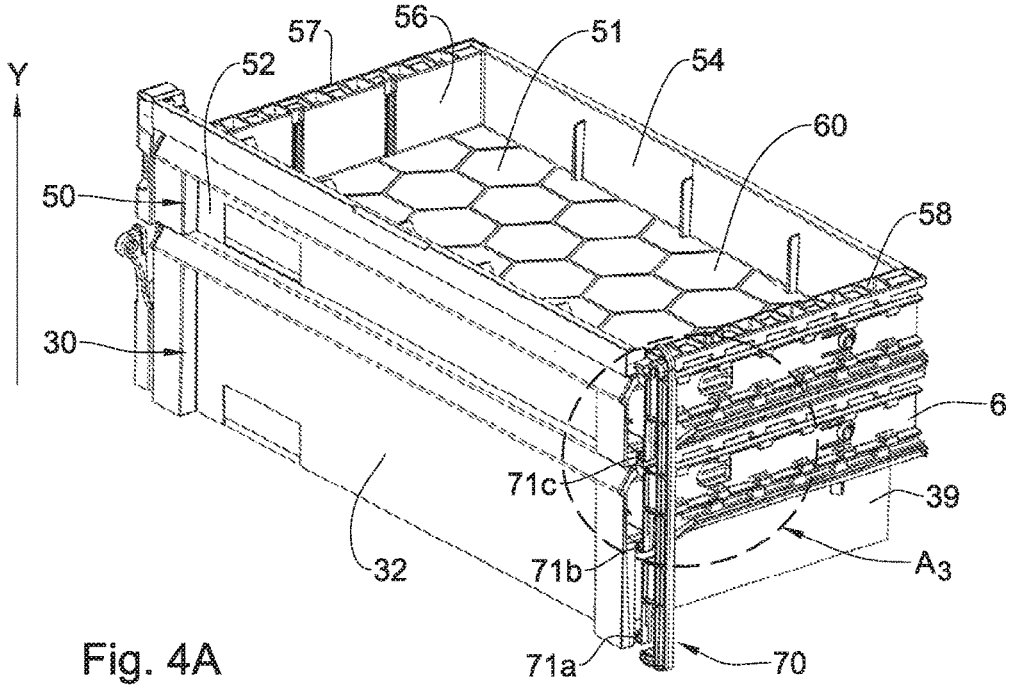
FIG. 4A is the cabinet of FIG. 1A, with its housing removed therefrom.
Figure 4B:
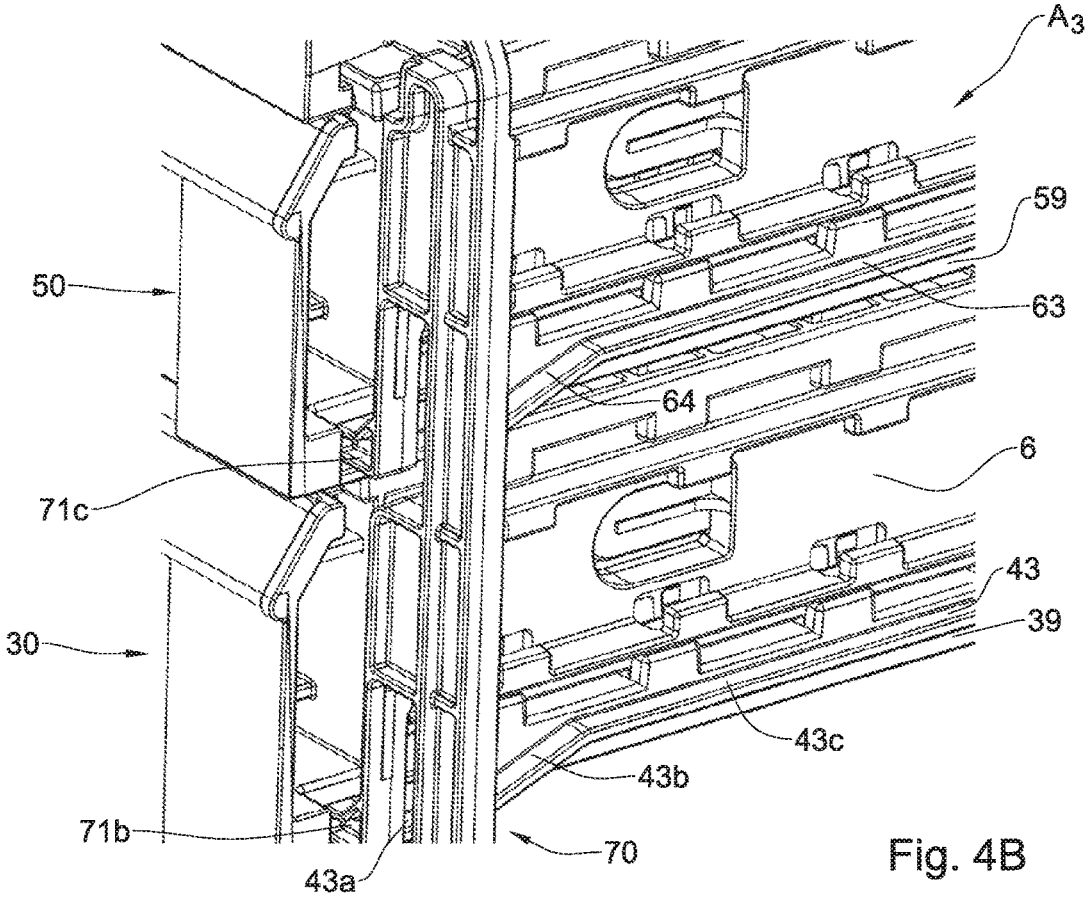
FIG. 4B is an enlarged view of a portion $A_3$ of FIG. 4A.

The blocking mechanism 70 is a single-molded elongate member oriented within the housing 10 along the vertical axis Y. The blocking mechanism 70 has three blocking-following members 71*a*, 71*b* and 71*c*, each associated with its corresponding drawer (if accommodated within the housing 10) for selectively arresting said corresponding drawer in its closed position. Each of the blocking-following members 71*a*, 71*b* and 71*c* is a blocking member and a following member integrally formed in a single member. As shown in FIGS. 4A and 4B, the blocking-following member 71*b* is associated with the drawer 30, the blocking-following member 71*c* is associated with the drawer 50, and the blocking-following member 71*a* is not associated with a specific drawer since the drawer 30 occupies a space of two drawers as mentioned above. The blocking-following members 71*a*, 71*b* and 71*c* laterally are integrally formed with the blocking mechanism 70 and constitute portions thereof. The blocking-following members 71*a*, 71*b* and 71*c* protrude from the blocking mechanism towards their corresponding drawers of the cabinet 1.

According to the example of the drawings, the blocking mechanism 70 is vertically displaceable along the axis Y between a downward unblocked state (shown in FIGS. 4A, 4B, 5A and 5B) in which each one of the drawers 30 and 50 is free to be displaced from its closed position to its open position and an upward blocked state (shown in FIGS. 7A, 7B, 8A and 8B) in which the drawer 50 is arrested in its closed position by its corresponding blocking-following member 71*c*, while the drawer 30 is in its open position. The blocking mechanism 70 is normally urged into its unblocked state by virtue of gravity forces.

Figure 3:
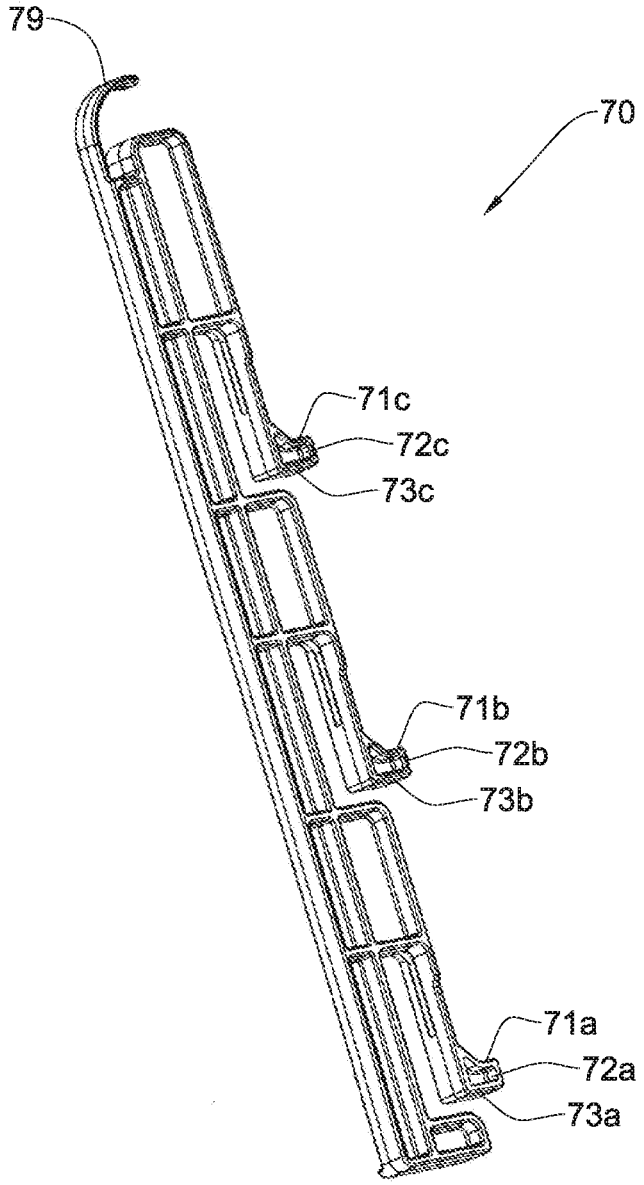
FIG. 3 is a rear isometric view of a blocking mechanism of the cabinet of FIG. 1A.

As shown in FIG. 3, the blocking mechanism 70 further has a biasing arrangement 79 disposed at the uppermost end thereof and configured for biasing the blocking mechanism 70 towards its unblocked state. The biasing arrangement 79 is constituted by a biasing spring arm configured to engage the top wall 14 of the housing 1, when the blocking mechanism is in its blocked state, and consequently to be bent. The elastic nature of the biasing arrangement 79 allows the arm to assume its original shape, thereby facilitating the displacement of the blocking mechanism 70 to its unblocked state, when possible.

It should be indicated that the description below is made to a particular example according to which the drawer 30 is displaced to its open position, while the drawer 50 is arrested in its closed position by virtue of the blocking mechanism 70. It is appreciated that if the drawer 50 is displaced to its open position instead of the drawer 30, the drawer 30 will be arrested in its closed position by virtue of the blocking mechanism 70 in the same manner as the drawer 50 is arrested when the drawer 30 is displaced to its open position.

Reference is now made again to FIGS. 2A to 2D, 3, 4A to 4B and 5A to 5B in order to describe the mechanical association between the blocking mechanism 70 and the drawers 30 and 50 when the drawer 30 is displaced from its closed position to its open position.

Figure 5A:
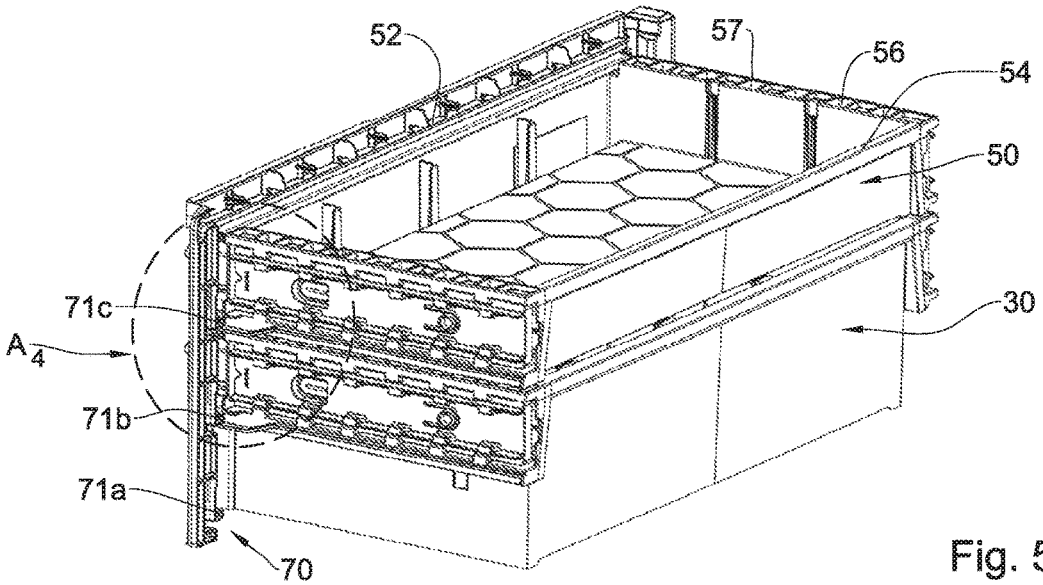
FIG. 5A is a rear left isometric view of the cabinet of FIG. 1A, with its housing removed therefrom.
Figure 5B:
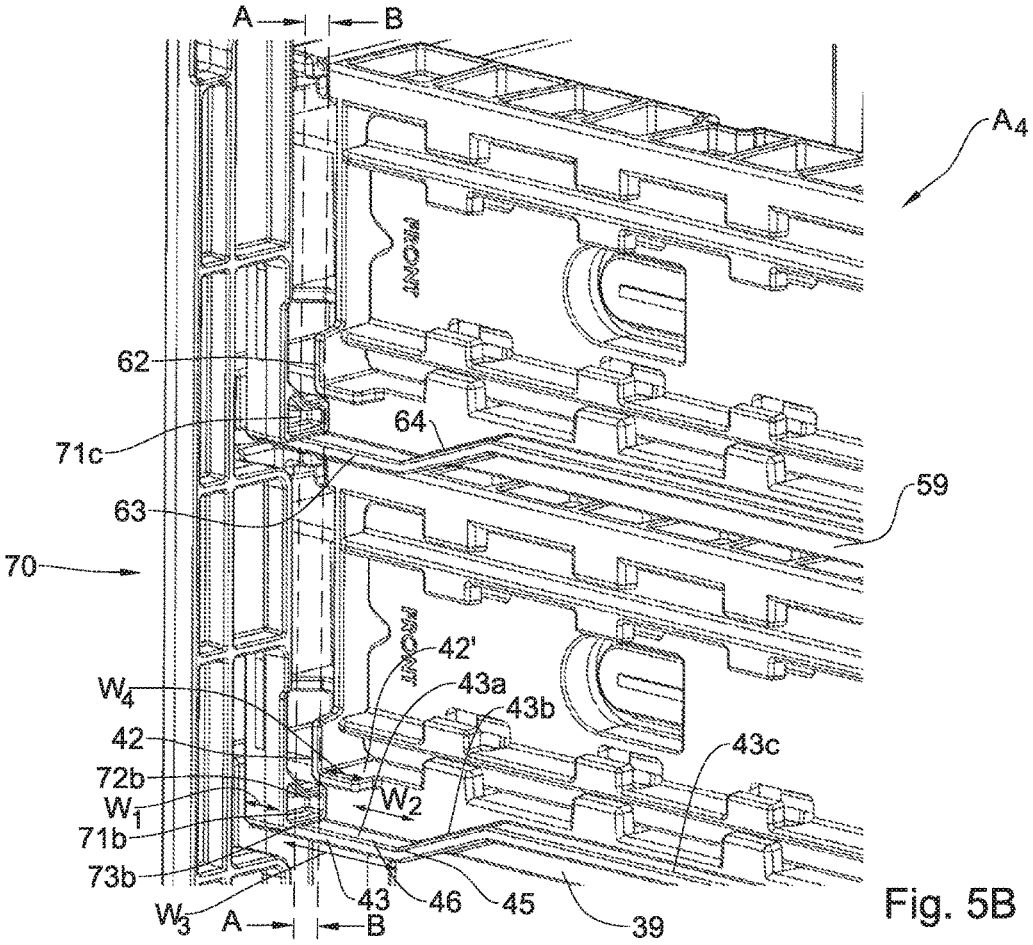
FIG. 5B is an enlarged view of a portion $A_4$ of FIG. 5A.

As clearly shown in FIGS. 2B and 5B, the drawer 30 has a restricting portion 42 and a guiding portion 43 which are mechanically associated with the blocking-following member 71*b*. The restricting portion 42 and the guiding portion 43 protrude from the left exterior surface 39 towards the left sidewall 18 of the housing 10, and particularly towards to blocking mechanism 70. The guiding portion 43 is disposed along and under the first element 4 of the slide mechanism 2. The guiding portion 43 has three portions: a first straight portion 43*a*, a ramp portion 43*b* and a second straight portion 43*c*. The the ramp portion 43*b* has a lower end 45 which is disposed between the first straight portion 43*a* and the ramp portion 43*b*.

As clearly shown in FIGS. 2D and 5B, the drawer 50 has a restricting portion 62 and a guiding portion 63 which are mechanically associated with the blocking-following member 71*c*. The restricting portion 62 and the guiding portion 63 protrude from the left exterior surface 59 towards the left sidewall 18 of the housing 10, and particularly towards to blocking mechanism 70. The guiding portion 63 is disposed along and under the first element of the slide mechanism of the drawer 50.

As shown in FIG. 3, each of the blocking-following members 71*a*, 71*b* and 71C has respectively two portions: a side blocking portion 72*a*, 72*b* and 72*c* and a bottom following portion 73*a*, 73*b* and 73*c*. Each of the blocking portions 72*a*, 72*b* and 72*c* constitutes a blocking member which is mechanically associated with the restricting portion of its corresponding drawer and each of the following portions 73*a*, 73*b* and 73*c* constitutes a following member which is mechanically associated with the guiding portion of its corresponding drawer. In particular, the blocking portion 72*b* is mechanically associate with the restricting portion 42, the blocking portion 72*c* is mechanically associate with the restricting portion 62, the following portion 73*b* is mechanically associate with the guiding portion 43, and the following portion 73*c* is mechanically associate with the guiding portion 63.

The association between the restricting portion 62 and the blocking-following members 71*c* and particularly with its blocking portion 72*c* is such that in the blocked state of the blocking mechanism 70, when the drawer 30 is in its open position and the drawer 50 is in its closed position, the blocking portion 72*c* obstructs the restricting portion 62, to thereby prevent displacement thereof into its open position.

In a similar manner, the association between the restricting portion 42 and the blocking-following members 71*b* and particularly with its blocking portion 72*b* is such that in the blocked state of the blocking mechanism 70, when the drawer 50 is in its open position and the drawer 30 is in its closed position, the blocking portion 72*b* obstructs the restricting portion 42, to thereby prevent displacement thereof into its open position.

As shown in FIG. 5B, the blocking-following members 71*a*, 71*b* and 71*c* are disposed along a first plane which passes through line AA and which is substantially parallel to the front frame 20 of the housing 10. As further shown in this figure, the restricting portions 42 and 62 are disposed along a second plane which passes through line BB and which is substantially parallel to the first plane. The first plane is closer to the front frame 20 than the second plane, and both planes are disposed in proximity to the front frame 20.

The blocking-following member 71*b* is sized for passing between the restricting portion 42 and the guiding portion 43 during the displacement of the drawer 30 between its closed position and its open position.

In a similar manner, the blocking-following member 71*c* is sized for passing between the restricting portion 62 and the guiding portion 63 during the displacement of the drawer 50 between its closed position and its open position.

Figure 5C:
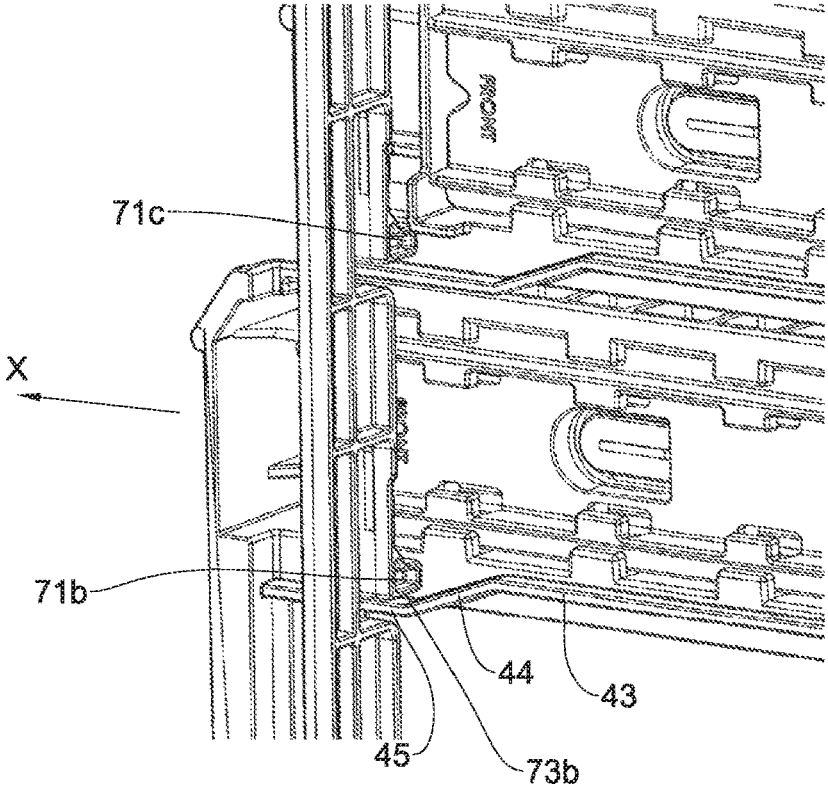
FIGS. 5C to 5E are rear isometric views of the portion $A_4$ of FIG. 5B, presented during consecutive steps of operation of the drawer.
Figure 5D:
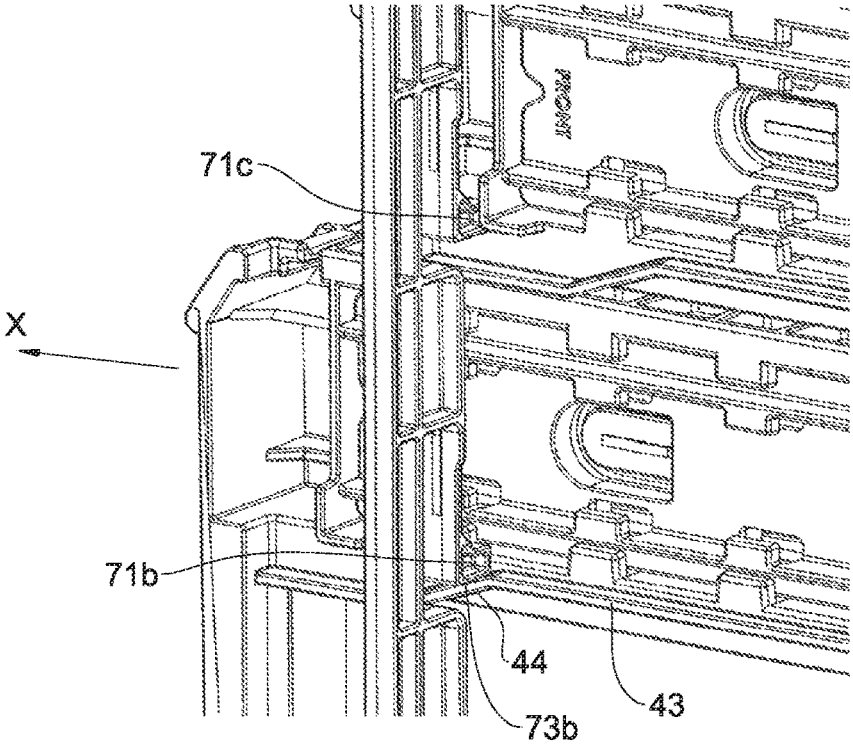
Figure 5E:
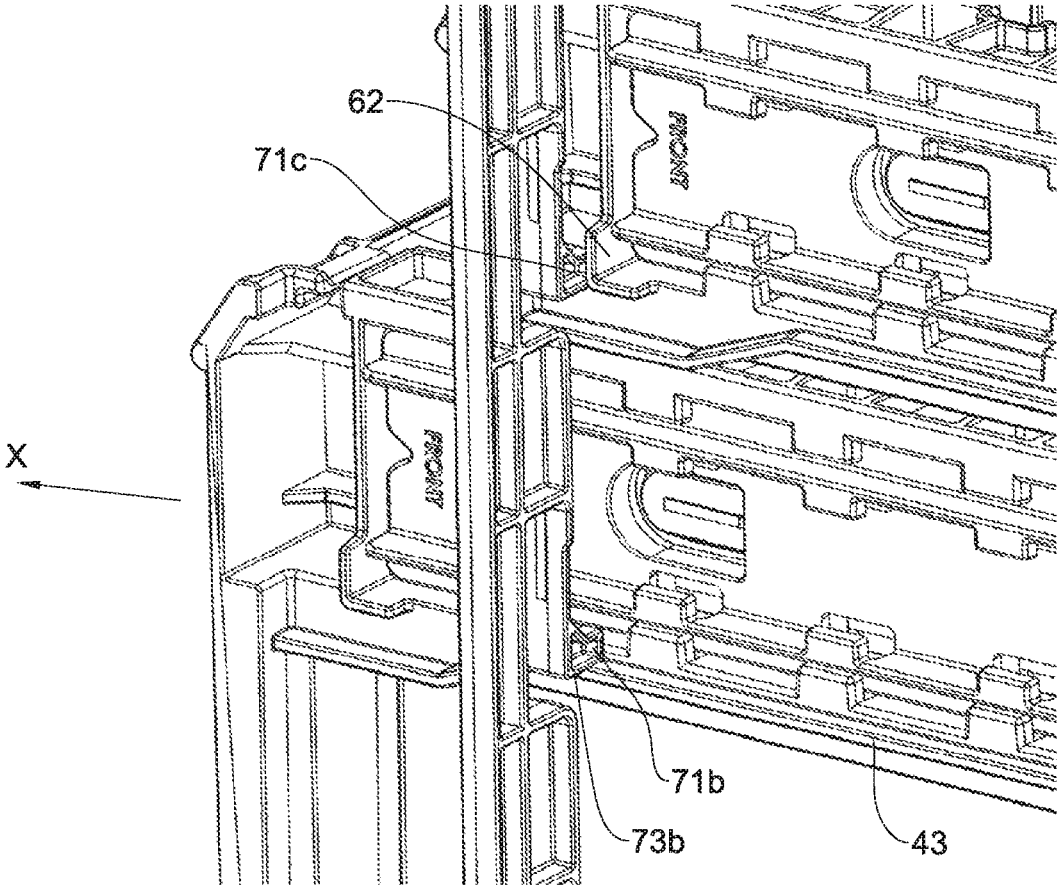

In order to describe the mechanical association between the guiding portion 43 and the following portion 73*b*, reference is now made particularly to FIG. 5B and additionally to FIGS. 5C to 5E, which illustrate the steps of displacement of the drawer 30 from its closed position to its open position, and consequent displacement of the blocking mechanism 70 to its blocked state. As shown in FIG. 5B, when the drawer 30 is in its closed position, the following portion 73*b* rests on the guiding portion 43. As shown in FIG. 5C, when the drawer 30 begins its displacement along a horizontal axis X to its open position, the following portion 73*b* slides over the first straight portion 43*a* of the guiding portion 43 until it reaches the lower end 45 of the ramp portion 43*b*. Upon further displacement of the drawer 30 along the axis X to its open position, as shown in FIG. 5D, the following portion 73*b* engages the ramp portion 43*b* and slides along its length. Due to the inclined structure of the ramp portion 43*b*, the following portion 73*b*, and consequentially the entire blocking mechanism 70 is urged to displace in the upward direction towards the blocked state of the blocking mechanism 70. As shown in FIG. 5E, the following portion 73*b* has passed the ramp portion 43*b*, and as a result of that, the blocking mechanism 70 is disposed in its blocked state. In this state of the blocking mechanism 70, the blocking-following member 71*c* is arresting the drawer 50 in its closed position. A detailed explanation of the blocked state of the blocking mechanism 70 is provided below. Further displacement of the drawer 30 from its position in FIG. 5E to its open position in FIGS. 6A and 6B does not influence on the blocking mechanism 70, which is already in its blocked state.

Reference is now made particularly to FIG. 5B, in which the following distances are used:

$W_1$—the width of the blocking following member 72;

$W_2$—the distance between the projection of the restricting member 42 on the first straight portion 43*a* and the lower end 45;

$W_3$—the distance between the blocking portion 72*b* and the lower end 45; and $W_4$—the length of a horizontal portion 42' of the restricting portion 42.

As seen in FIG. 5B, since $W_1$ is smaller than $W_2$ ($W_1<W_2$), during its sliding along the first straight portion 43*a* along a distance of $W_4$, the blocking-following member 71*b* is able to pass by the restricting portion 42, and particularly its horizontal portion 42', before engaging the lower end 45 and starting to vertically displace in the upward direction. Only after passing by the restricting portion 42 and engaging the ramp portion 43*b*, the blocking-following member 71*b* starts to vertically displace in the upward direction together with the entire blocking mechanism 70. Thus, since the blocking portion 72*b* is disposed behind the restricting portion 42, the blocking mechanism in its blocked state arrest the drawer 30 in its closed position.

In addition to the open and the closed positions of the drawers 30 and 50, these drawers also have an intermediate position in which the drawer projects from the housing to an extent greater than in the closed position and smaller than in the open position, while the blocking mechanism 70 is still in its unblocked state.

The maximal extent to which the drawers can be displaced and still be in the intermediate position is defined by the distance $W_3$, which is shown in FIG. 5B.

Since the displacement of the drawer 30 to its intermediate position does not entail displacement of the blocking mechanism 70, the drawer 50 which is not arrested in its closed position, can also be displaced to its intermediate position. The intermediate distance $W_3$ can be such that when all the drawers of the cabinet, i.e., the drawer 30 and the drawer 50 are in their intermediate position, there is no danger of tipping over of the cabinet.

It should be indicated that in the intermediate position of the drawer 30, the blocking mechanism 70, and particularly its following portion 73*b*, rests on the first straight portion 43*a* of the guiding portion 43. In this position, the gravity forces which are constantly applied on the blocking mechanism 70 will not cause any displacement of the blocking mechanism 70 in the downward direction. Therefore, the drawer 30 will not be displaced from this position due to the existence of these gravity forces.

When the displacement of the drawer 30 from its closed position is stopped in a position in which the following portion 73*b* rests on the ramp portion 43*b*, the gravity forces that are constantly applied on the blocking mechanism 70 may cause the blocking mechanism 70 to move in the downward direction, thereby causing the following portion 73*b* to slide on the ramp portion 43*b* towards the first straight portion 73*a* which in turn will entail displacement of the drawer 30 to its intermediate or closed position.

When the displacement of the drawer 30 from its closed position is stopped in a position in which the following portion 73*b* rests on the second straight portion 43*c*, the gravity forces that are constantly applied on the blocking mechanism 70 will not cause any displacement of the blocking mechanism 70 in the downward direction. Therefore, the drawer 30 will not be displaced from this position due to the existence of these gravity forces.

Reference is now made to FIGS. 7A, 7B, 8A and 8B in order to describe the mechanical association between the blocking mechanism 70 and the drawers 30 and 50 when the drawer 30 is in its open position and the drawer 50 is arrested in its closed position by the blocking mechanism 70.

In the blocked state of the blocking mechanism 70, when the drawer 30 is in its open position, the blocking portion 72*c* is aligned with the restricting portion 62 so that during an attempt to displace the drawer 50 from its closed position to its open position, the blocking portion 72*c* engages the restricting portion 62 to thereby obstruct the drawer 50 and prevent its displacement to its open position.

Upon displacement of the drawer 30 back to its closed position, the blocking mechanism reverts to its unblocked state by virtue of gravity forces and the operation of the biasing arrangement 79 which tends to revert to its original shape and thereby bias the blocking mechanism 70 to its unblocked state.

Figure 9A:
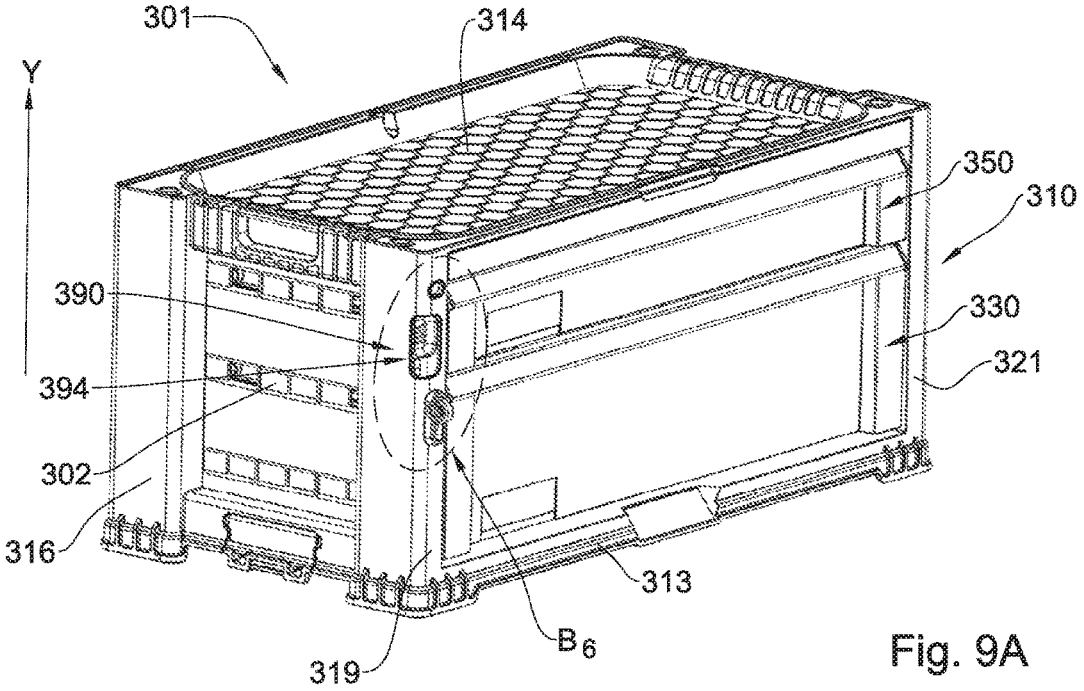
FIG. 9A is a front right isometric view of a cabinet, in accordance with another example of the presently disclosed subject matter.
Figure 9B:
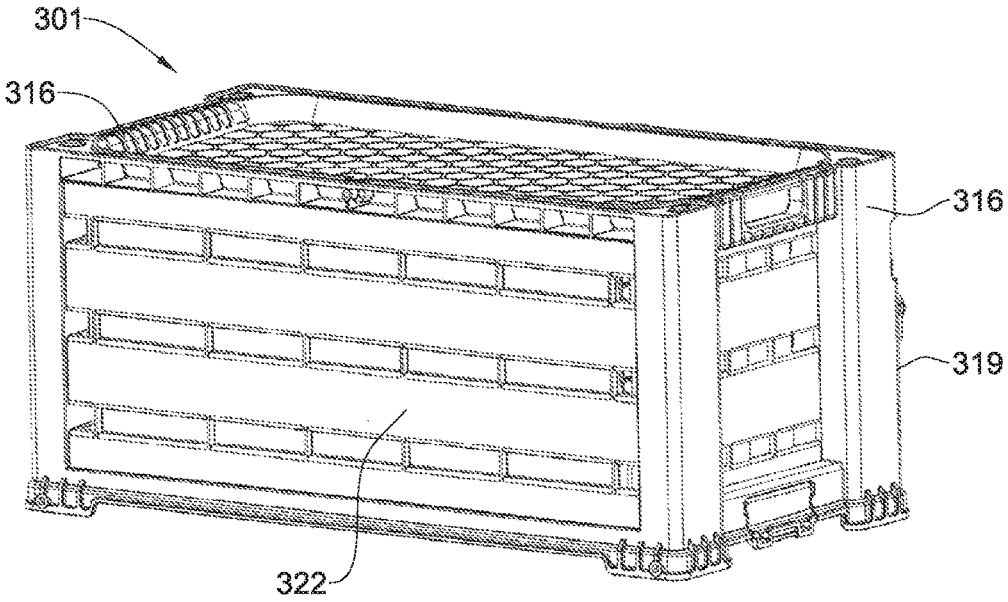
FIG. 9B is a rear right isometric view of the cabinet of FIG. 9A.

Attention is now directed to FIGS. 9A to 10E, 14A and 14B of the drawings illustrating a cabinet in accordance with another example of the presently disclosed subject matter, generally designated 301. The cabinet 301 comprises a housing 310 and two storage units in the form of drawers, including a lower drawer 330 and an upper drawer 350, each accommodated within the housing 310 and slidingly displaceable between a closed position in which the drawer is disposed within the housing 310 and an open position in which the drawer projects from the housing 310. The drawers 330 and 350 are vertically stacked within the housing 310 along a vertical axis Y. In FIGS. 9A and 9B, the drawers 330 and 350 are in their closed position, and in FIGS. 14A and 14B, the drawer 330 is in its open position and the drawer 350 is in its closed position.

Figure 10A:
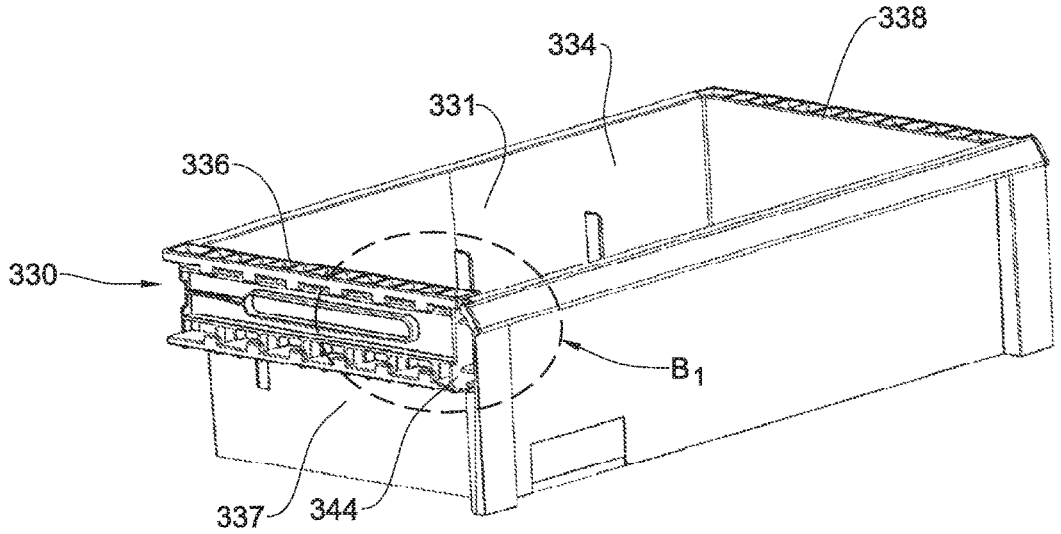
FIG. 10A is a front right isometric view of a lower drawer of the cabinet of FIG. 9A.
Figure 10B:
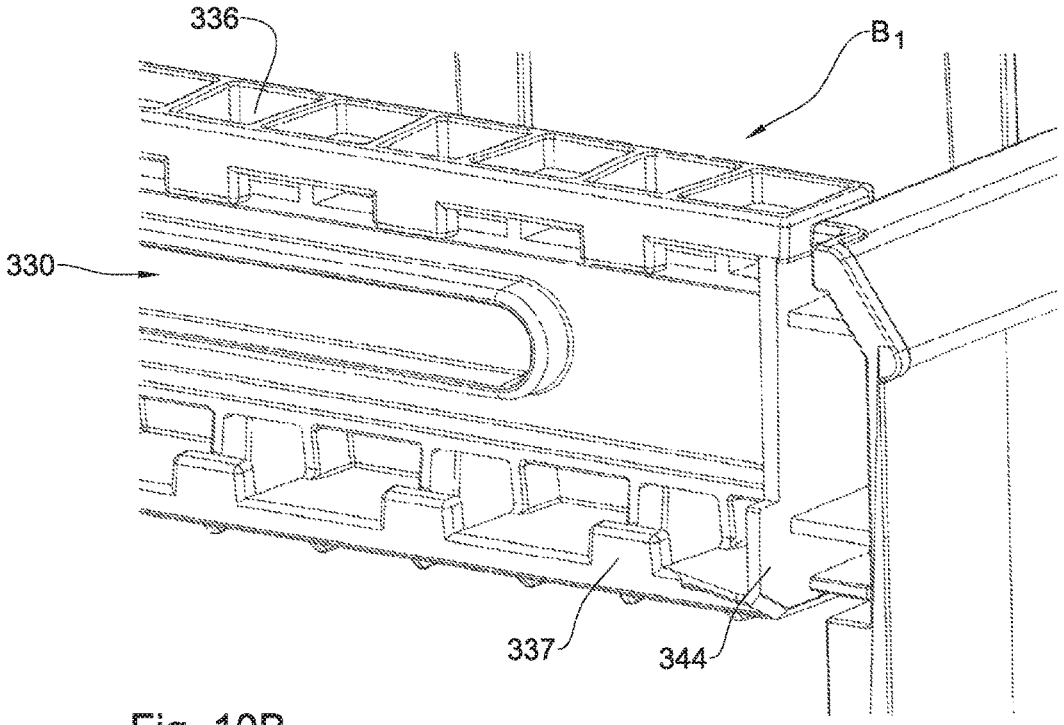
FIG. 10B is an enlarged view of a portion $B_1$ of FIG. 10A.
Figure 10C:
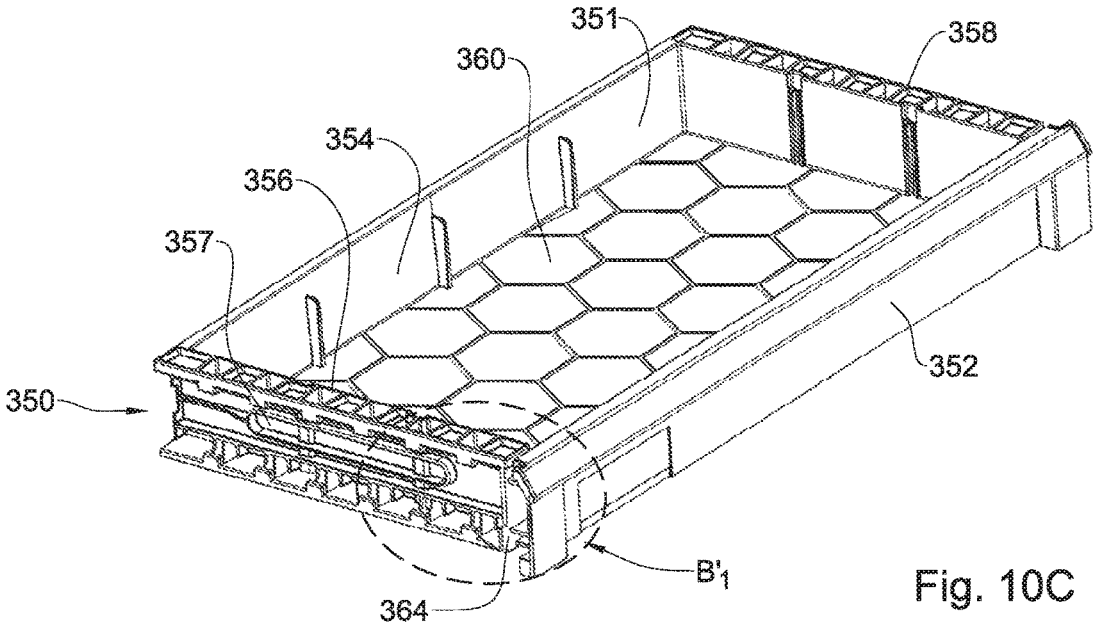
FIG. 10C is a front right isometric view of an upper drawer of the cabinet of FIG. 9A.
Figure 10D:
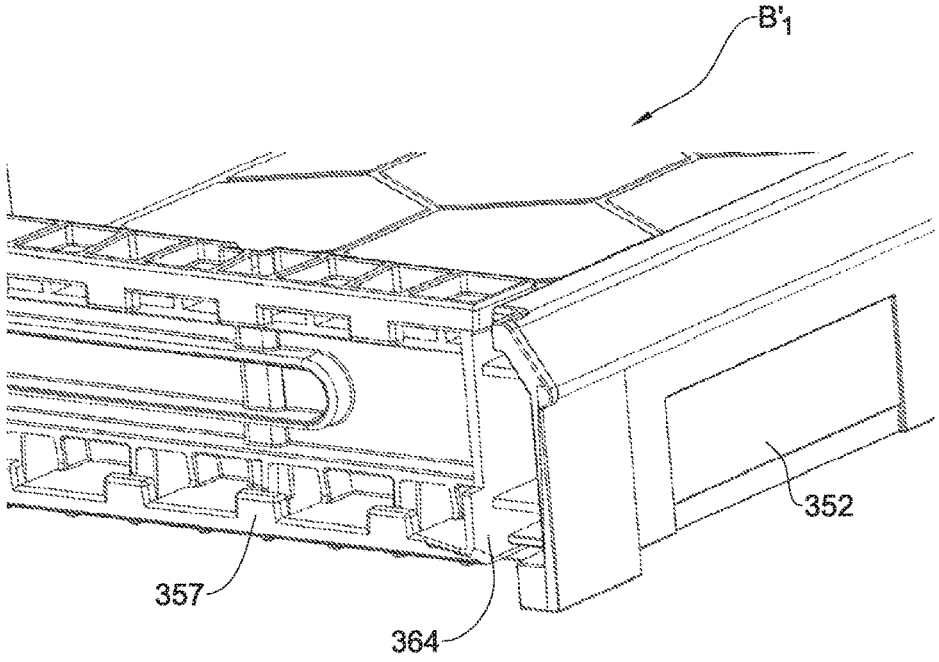
FIG. 10D is an enlarged view of a portion $B_1'$ of FIG. 10C.
Figure 10E:
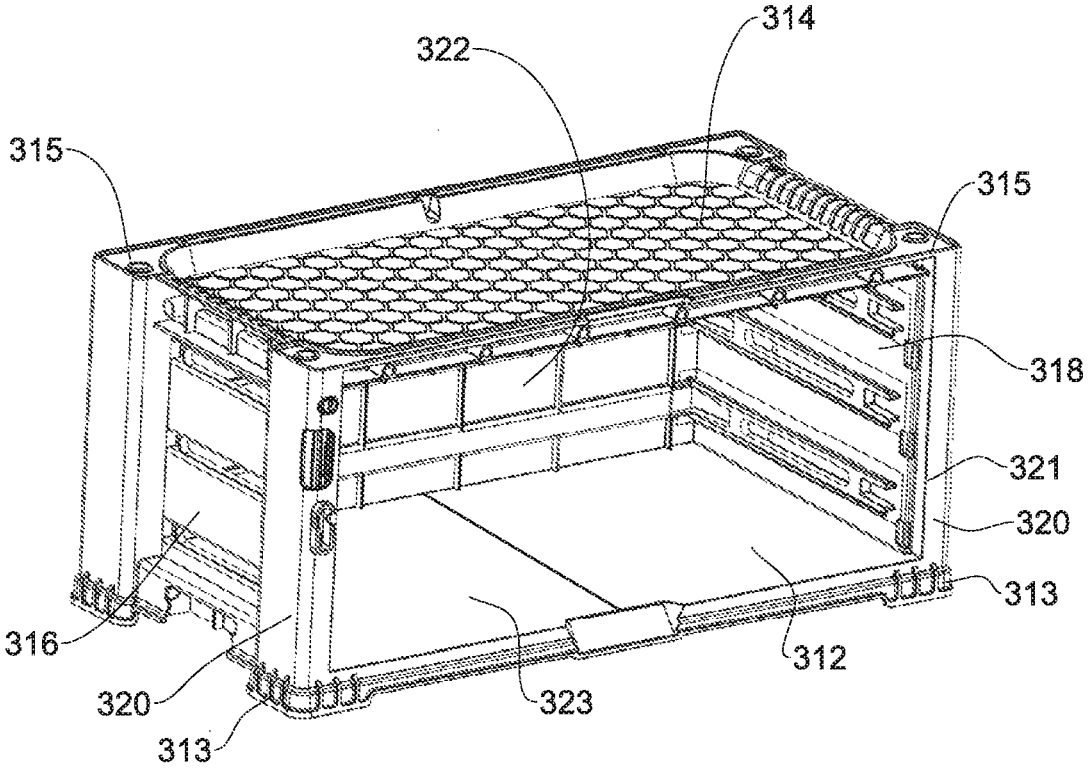
FIG. 10E is a front right isometric view of a housing of the cabinet of FIG. 9A, with the drawers being removed.
Figure 11:
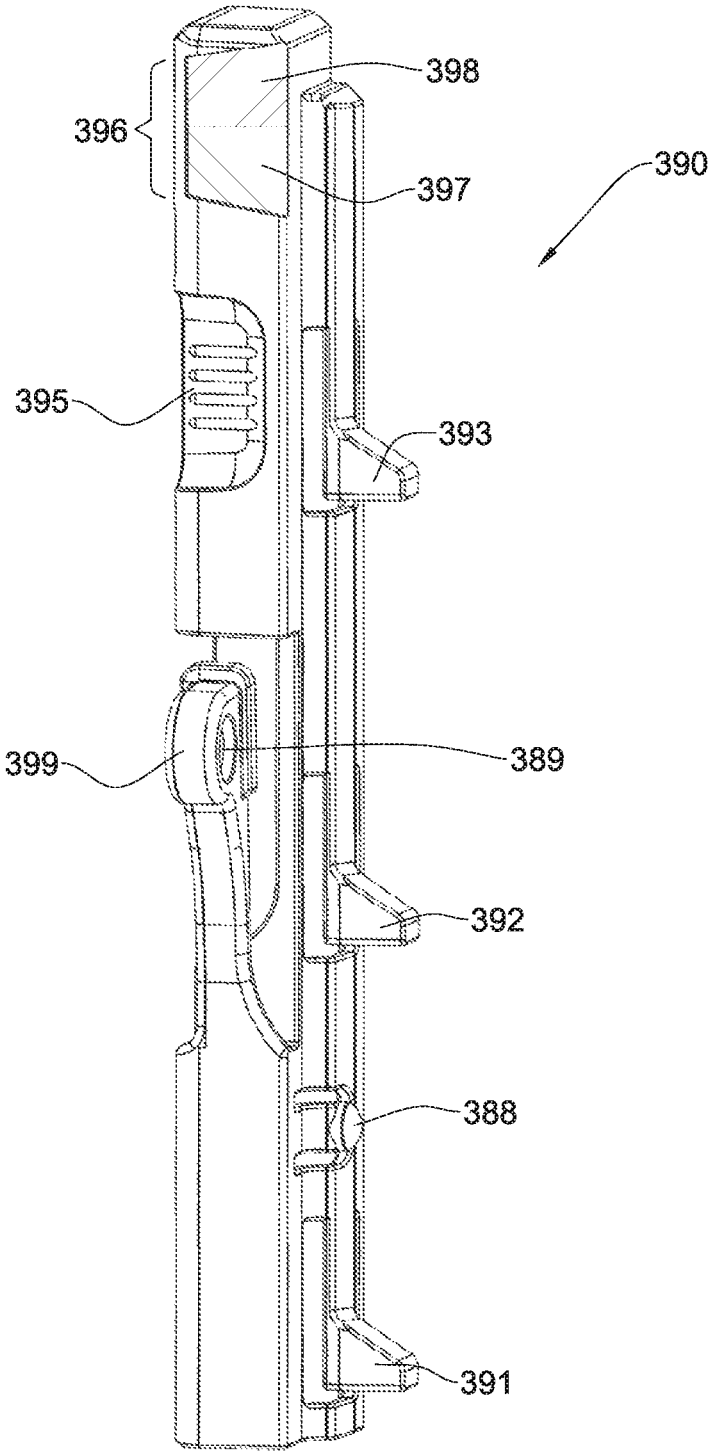
FIG. 11 is a front isometric view of a locking mechanism of the cabinet of FIG. 9A, according to another aspect of the presently disclosed subject matter.
Figure 12A:
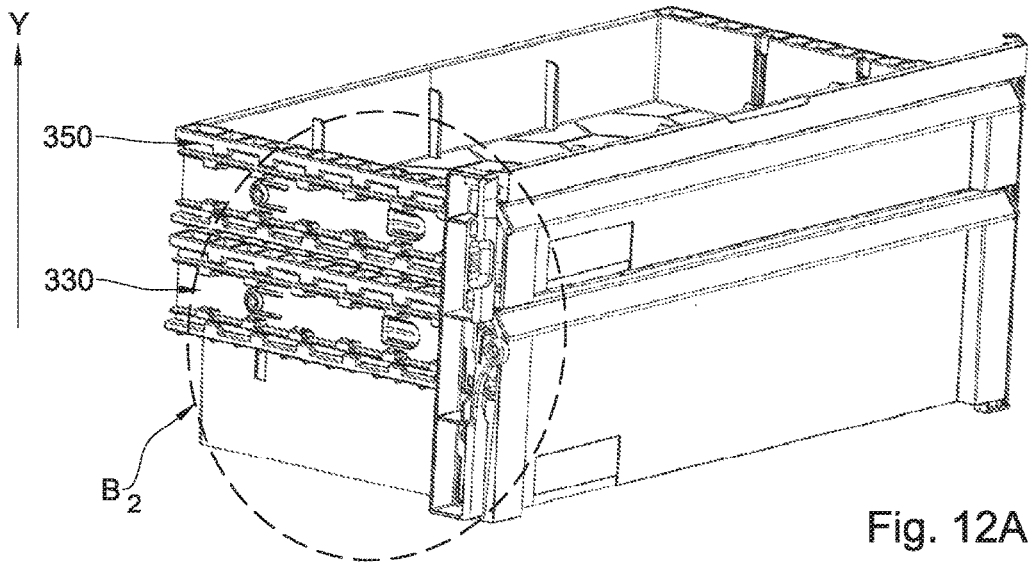
FIG. 12A is the cabinet of FIG. 9A, with its housing removed therefrom.
Figure 12B:
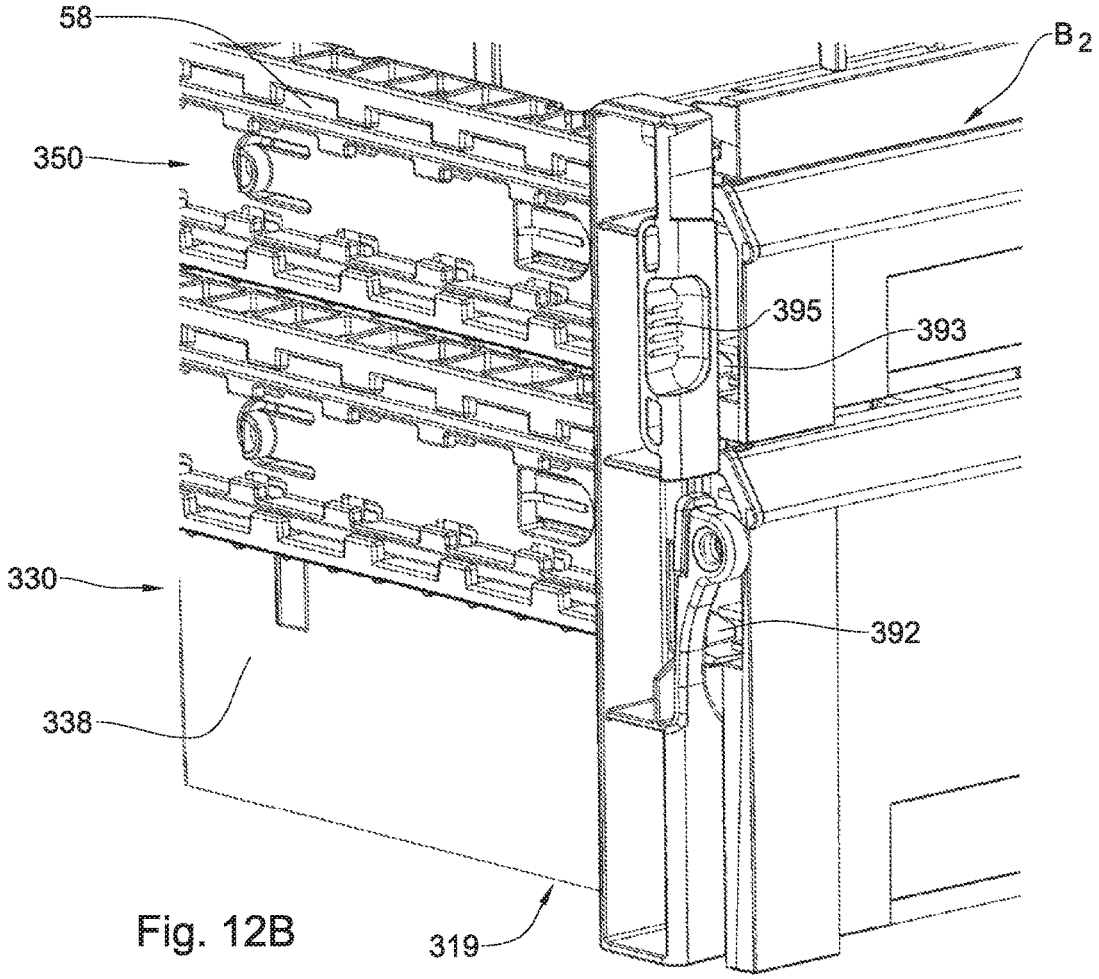
FIG. 12B is an enlarged view of a portion $B_2$ of FIG. 12A.

As shown in FIG. 10E, the housing 310 has a base section 312 with a base rim 313, a top section 314 with a top rim 315, a right sidewall 316, a left sidewall 318, a front frame 320 with an opening therein and a rear wall 322. The front frame 320 has a right front edge 319 and a left front edge 321. The housing 310 further has a housing cavity 323 defined by the base section 312, the top section 314, the sidewalls 316 and 318, and the walls 320 and 322. The housing cavity 323 is configured to accommodate the drawers 330 and 350 therein.

It is appreciated that the number of the drawers is not limited to two. An example of a cabinet with three drawers in presented in FIG. 18A. According to the present example, the drawer 330 occupies a space of two drawers, each having dimensions similar to those of the drawer 350.

As shown in FIG. 10A, the drawer 330 has a front wall 332, a rear wall 334, a right sidewall 336, a left sidewall 338 and a base section (not seen). The front and rear walls 332 and 334, the right and left sidewalls 336 and 338, and the base section of the drawer 330 define together a cavity 331 configured for accommodating work tools and appliances. The right sidewall 336 has a right exterior surface 337 and the left sidewall 338 has a left exterior surface 339.

As shown in FIG. 10C, the drawer 350 has a front wall 352, a rear wall 354, a right sidewall 356, a left sidewall 358 and a base section 360. The front and rear walls 352 and 354, the right and left sidewalls 356 and 358, and the base section 360 define together a cavity 351 configured for accommodating work tools and appliances. The right sidewall 356 has a right exterior surface 357 and the left sidewall 358 has a left exterior surface 359.

Each of drawers 330 and 350 is slidingly displaceable with respect to the housing 10 by two slide mechanisms interconnecting each drawer to the housing 10. Each of the two slide mechanisms is a full-extension mechanism being disposed at a respective sidewall of each drawer.

Reference is now made to FIGS. 9A to 14B in which the cabinet 301 is illustrated with a locking mechanism 390 disposed therein, in accordance with another aspect of the presently disclosed subject matter. The locking mechanism 390 is disposed within the housing 310 in proximity to the right front edge 319, between the right sidewall 316 of the housing 310 and the right sidewalls 336 and 356 of the drawers 330 and 350. The locking mechanism 390 is mechanically associated with the drawers 330 and 350 for controlling the ability of a user to open at least one of the drawers 330 and 350 of the cabinet 301. This control allows selectively arresting all the drawers of the cabinet 301, i.e., the drawers 330 and 350, in their closed position and respectively releasing the drawers 330 and 350 from their arrested position, and thereby allowing each one of the drawers to be displaced to its open position.

As shown in FIGS. 11, 12A, 12B, 13A and 13B, the locking mechanism 390 is a single-molded elongate member oriented within the housing 310 along the vertical axis Y. The locking mechanism 390 has three locking members 391, 392 and 393, each associated with its corresponding drawer (if accommodated within the housing 310) for selectively arresting the drawers 330 and 350 in their closed position, and respectively allowing the drawers 330 and 350 to be displaced to their open position. The locking member 392 is associated with the drawer 330, the locking member 393 is associated with the drawer 360, and the locking member 391 is not associated with any specific drawer since the drawer 330 has a double depth as mentioned above. The locking members 391, 392 and 393 are integrally formed with the locking mechanism 390 and constitute a portion thereof.

The locking mechanism 390 is vertically displaceable along the axis Y between an upward locked state (shown in FIGS. 12A, 12B, 13A and 13B) in which the drawers 330 and 350 of the cabinet 301 are arrested in their closed position by their corresponding locking members 392 and 393, and a downward unlocked state (shown in FIGS. 15A, 15B, 16A and 16B) in which each of the drawers 330 and 350 of the cabinet 301 is free to be displaced from its closed position to its open position.

The locking mechanism 390 further comprises a stopping element 388 protruding therefrom. When the locking mechanism 390 is displaced to its upward locked state, the stopping element 388 is configured to be received in a corresponding first cavity (not shown) formed within the housing 310, and thereby to be stopped at the locked state. This function of the stopping element 388 will prevent from gravity forces to displace the locking mechanism to its downward unlocked state. When the locking mechanism 390 is displaced to its unlocked state, the stopping element 388 is configured to be received in a corresponding second cavity (not shown) formed within the housing 310, and thereby to be stopped at the unlocked state. When the stopping element 388 is received within the first and the second cavities, the user may feel or hear a 'click', which can provide indication and feedback regarding the state of the locking mechanism 390.

As shown in FIGS. 10A, 10B, 13A and 13B, the drawer 330 has an arresting portion 344 which is configured to be mechanically associated with the locking member 392 by arresting this drawer in its closed position, and the drawer 350 has an arresting portion 364 (shown in FIG. 13B) which is configured to be mechanically associated with the locking member 393 by arresting this drawer in its closed position. The arresting portions 344 and 364 protrude from the right exterior surfaces 337 and 357, respectively, towards the right sidewall 316 of the housing 310, and particularly towards to locking mechanism 390.

Figure 13A:
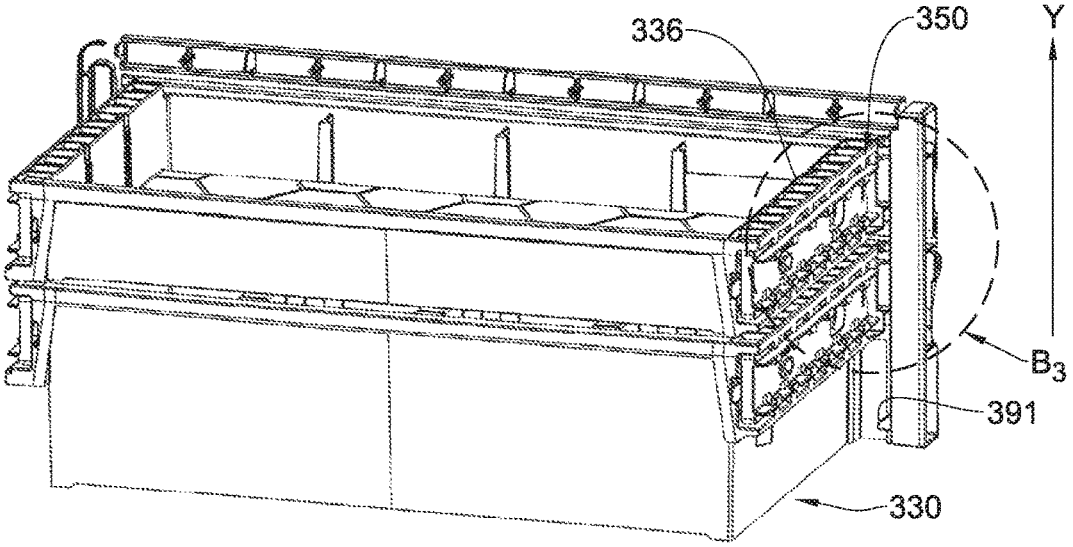
FIG. 13A is a rear right isometric view of the cabinet of FIG. 9A, with its housing removed therefrom.
Figure 13B:
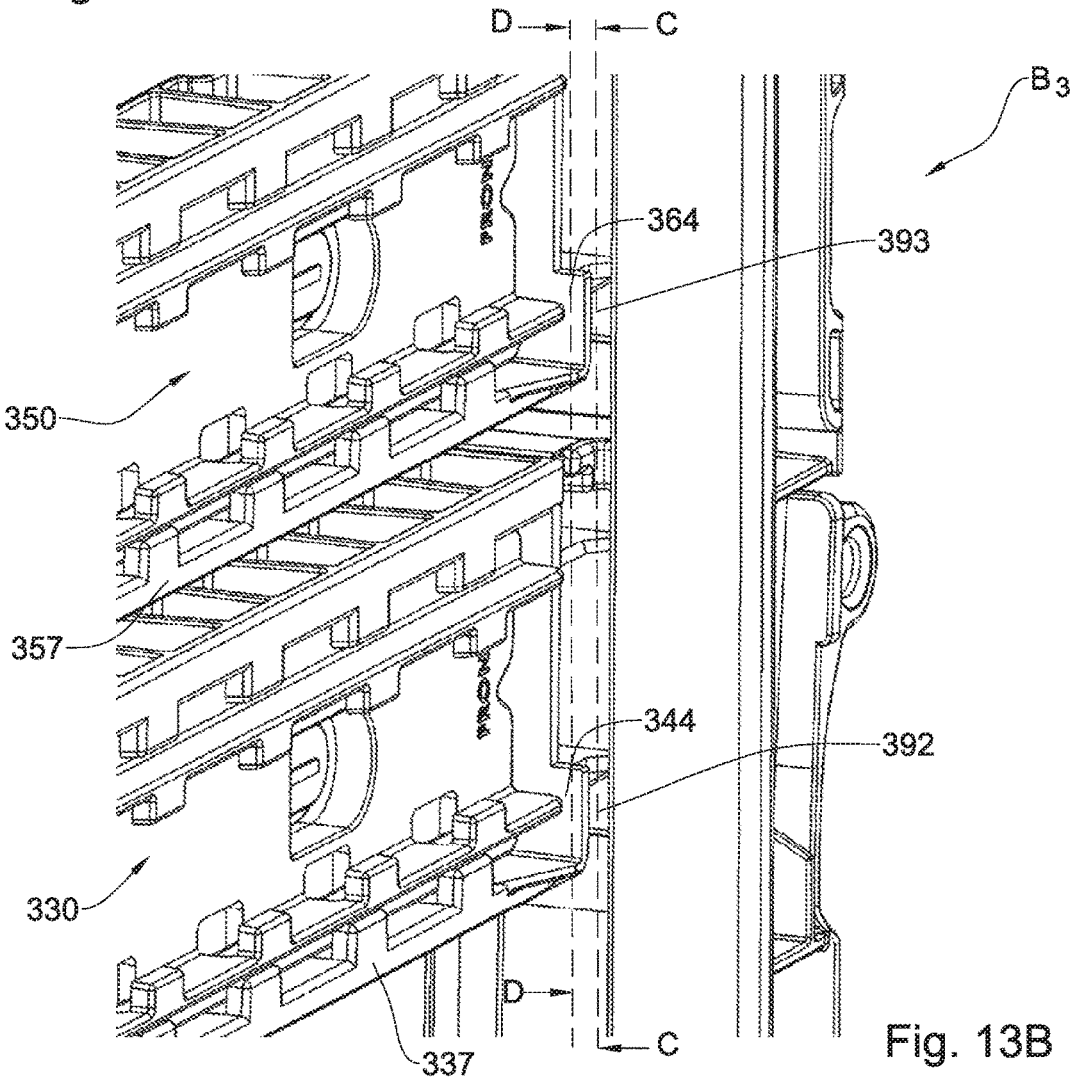
FIG. 13B is an enlarged view of a portion $B_3$ of FIG. 13A.
Figure 14A:
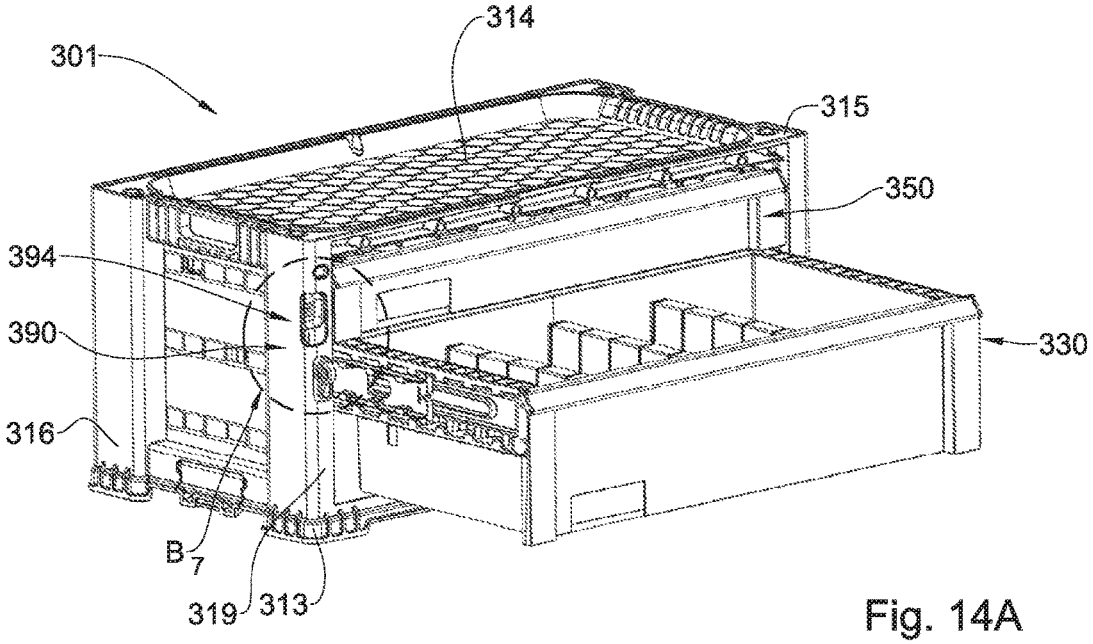
FIG. 14A is a front right isometric view of the cabinet of the FIG. 9A with one drawer shown in its open position and another drawer shown in its closed position.
Figure 14B:
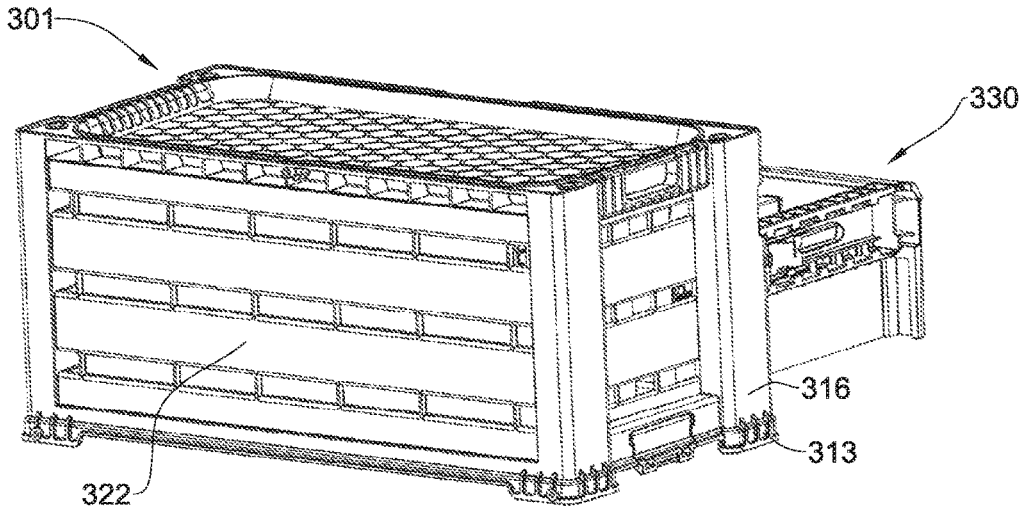
FIG. 14B is a rear right isometric view of the cabinet of the FIG. 14A.
Figure 15A:
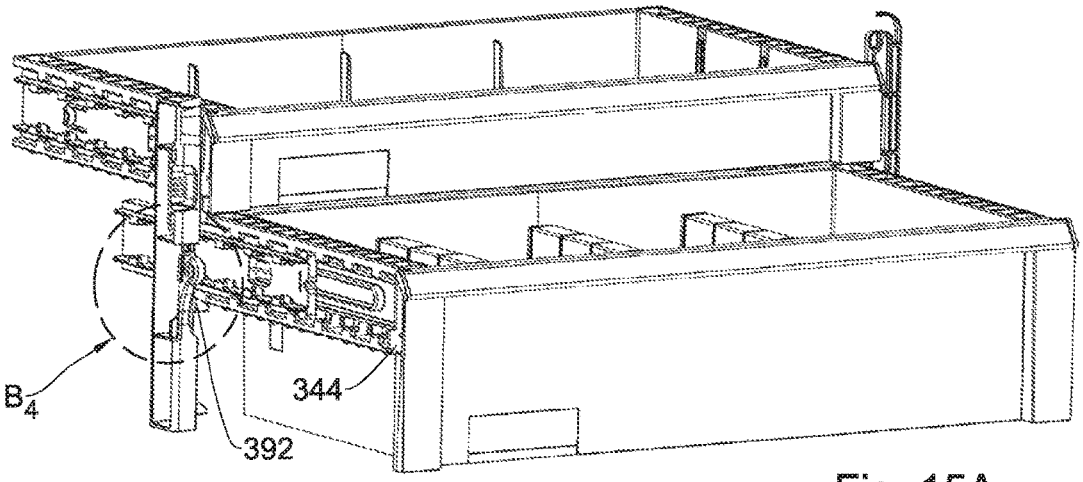
FIG. 15A is the cabinet of FIG. 14A, with its housing removed therefrom.
Figure 15B:
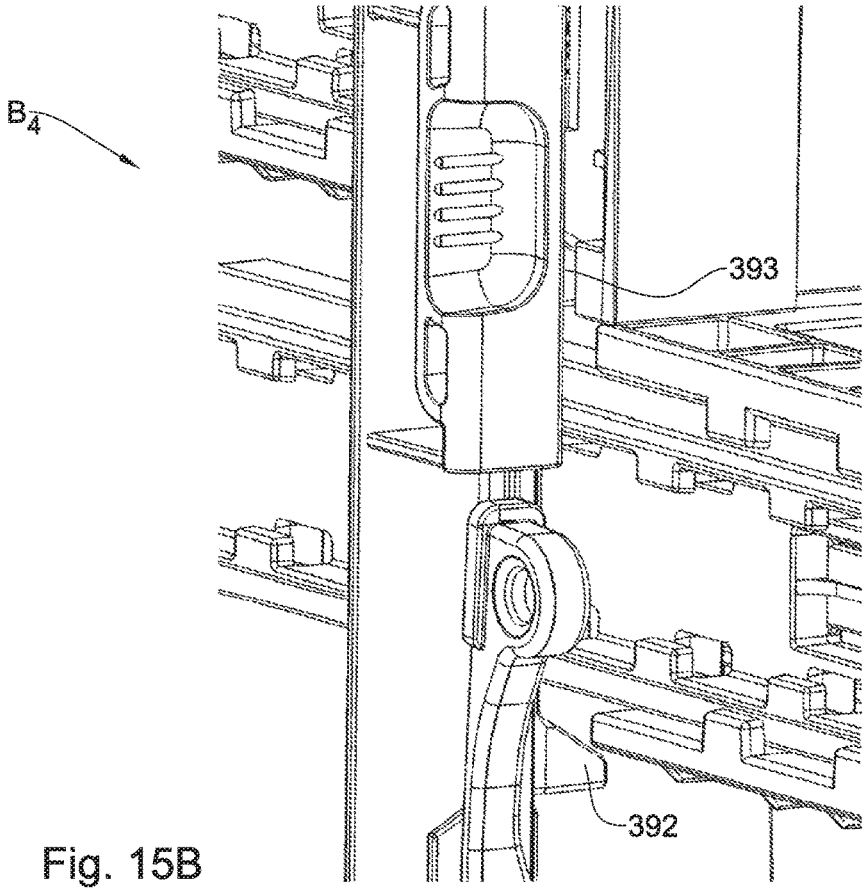
FIG. 15B is an enlarged view of a portion $B_4$ of FIG. 15A.
Figure 16A:
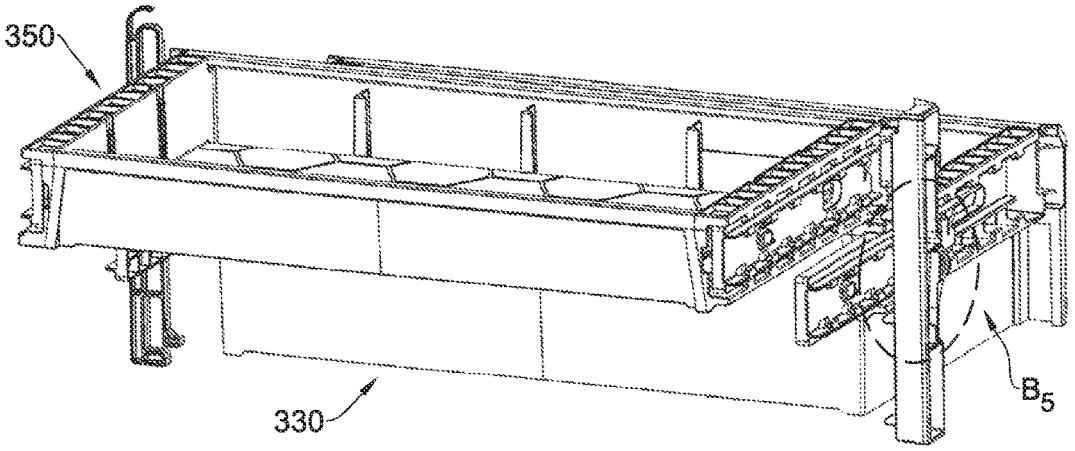
FIG. 16A is a rear right isometric view of the cabinet of FIG. 15A, with its housing removed therefrom.
Figure 16B:
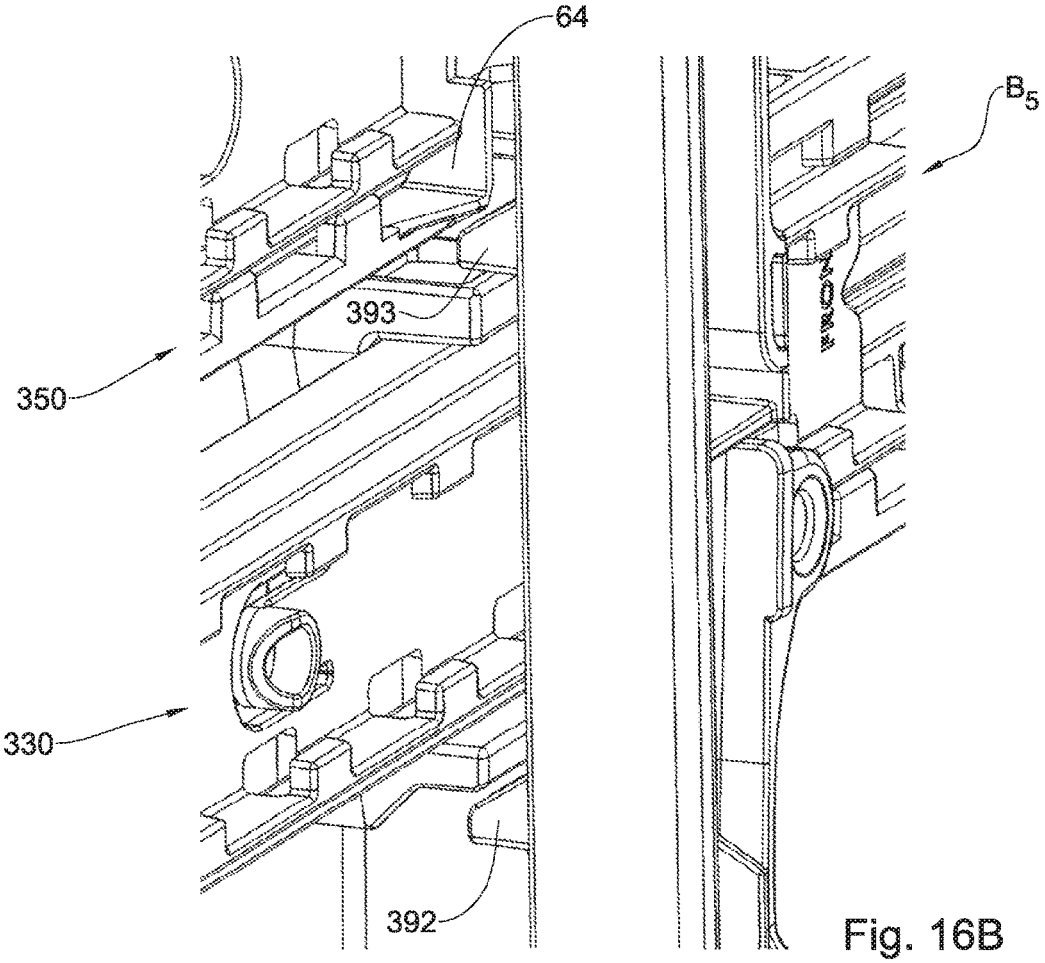
FIG. 16B is an enlarged view of a portion $B_5$ of FIG. 16A.

According to FIG. 13B, the locking members 391, 392 and 393 are disposed along a third plane which passes through line CC and which is parallel to the front frame 320 of the housing 310, and the arresting portions 344 and 364 are disposed along a fourth plane which passes through line DD and which is parallel to the third plane. The third plane is closer to the front frame 320 than the fourth plane, and both planes are disposed in proximity to the front frame 320.

As shown in FIG. 13B, in which the locking mechanism 390 is in its locked state, the mechanical association between the arresting portions 344 and 364 and the locking members 392 and 393 is such that the locking members 392 and 393 are aligned with their corresponding arresting portions 344 and 366. In this position of the locking mechanism 390, during an attempt to displace one of the drawers 330 and 350 from its closed position to its open position, the corresponding locking member 392 or 393 engages the corresponding arresting portion 344 or 364 to thereby obstruct the drawer and prevent displacement thereof to its open position.

Reference is now made particularly to FIGS. 15A, 15B, 16A, 16B, 17A and 17B, in which the locking mechanism 390 is displaced to its unlocked state, allowing any one of the drawers 330 and 350 to be displaced to its open position. According to the particular example of these figures, the drawer 330 is displaced to its open position.

In the unlocked state of the locking mechanism 390, this mechanism is vertically displaced in a downward direction, thereby causing the locking members 392 and 393 to be misaligned with the arresting portions 344 and 364 and to be disposed under these portions. This disposition of the locking members 392 and 393 with respect to the arresting portions 344 and 364 allows any of the drawers to be displaced to its open position without engaging its corresponding locking member. As shown for example in FIG. 16B, the drawer 330 is displaced to its open position by to the fact that the locking member 392 was misaligned with its arresting portion 344. Due to the existence of the blocking mechanism 370 in the cabinet 301, only if the drawer 330 will be displaced to its closed position, the drawer 350 will be allowed to be displaced to its open position since the arresting portion 364 is misaligned with the locking member 393.

Reference is now made to FIGS. 9A, 11, 17A and 17B in which further elements of the locking mechanism 390 are presented. The locking mechanism 390 has an actuator 394 configured for displacing the locking mechanism between its unlocked state and its locked state. The actuator has an actuator cavity 395 configured to accommodate at least one finger of a user for allowing him to displace the locking mechanism between its unlocked state and its locked state. The right front edge 319 has an actuator window 324 configured for providing access to the actuator cavity 395. The actuator 394 has an upward state corresponding to the locked state of the locking mechanism 390 and a downward state corresponding to the unlocked state of the locking mechanism 390.

Figure 17A:
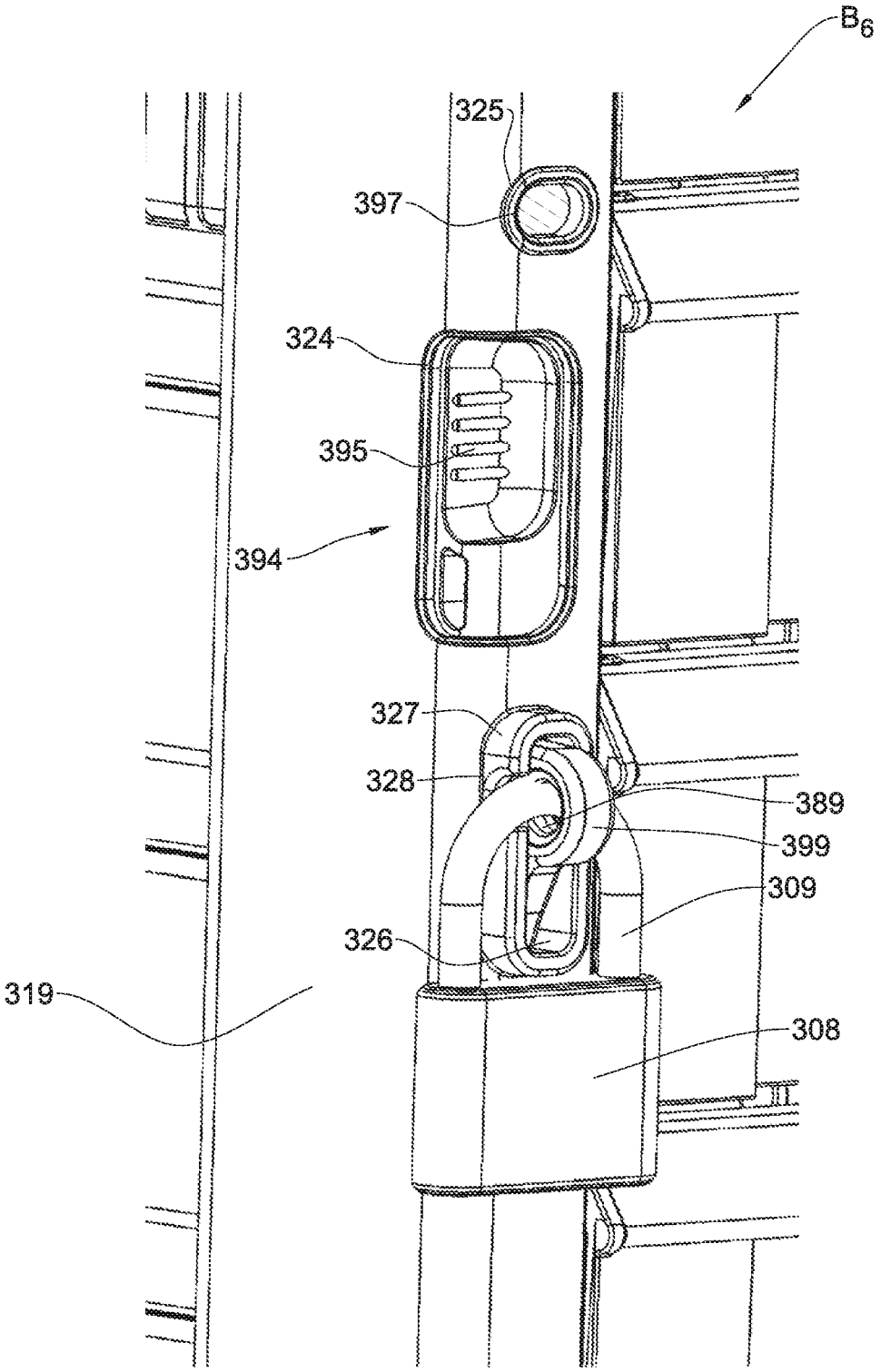
FIG. 17A is an enlarged view of a portion $B_6$ of FIG. 9A.

As shown in FIG. 17A, in which the locking mechanism 390 is disposed in its locked state, the actuator cavity 395 is disposed in its upward state. In order to displace to locking mechanism 390 to its unlocked state, the user can apply a downwardly directed pushing force on the actuator 394 and against the stopping element 388 which is received within the first cavity. This will result in displacement of the locking mechanism 390 to its unlocked state which is shown in FIG. 17B.

The actuator 394 is configured with an indicating member 396 (shown in FIG. 11), visible via an indicating window 325 (shown in FIGS. 17A and 17B) formed within the right front edge 319 of the housing 310, and configured for indicating the state in which the locking mechanism 390 is disposed to the user. The indicating member 396 has a first portion 397 with a first color associated with the locked state of the locking mechanism 390, and a second portion 398 with a second color associated with the unlocked state of the locking mechanism 390. The indicating window 325 is configured to provide visual indication of one of the first and the second portions 397 and 398 at a time, thereby indicating respectively the state at which the locking mechanism 90 is disposed. It should be appreciated that indication by means other than color can be applied. These means can include text, touch, etc.

Figure 17B:
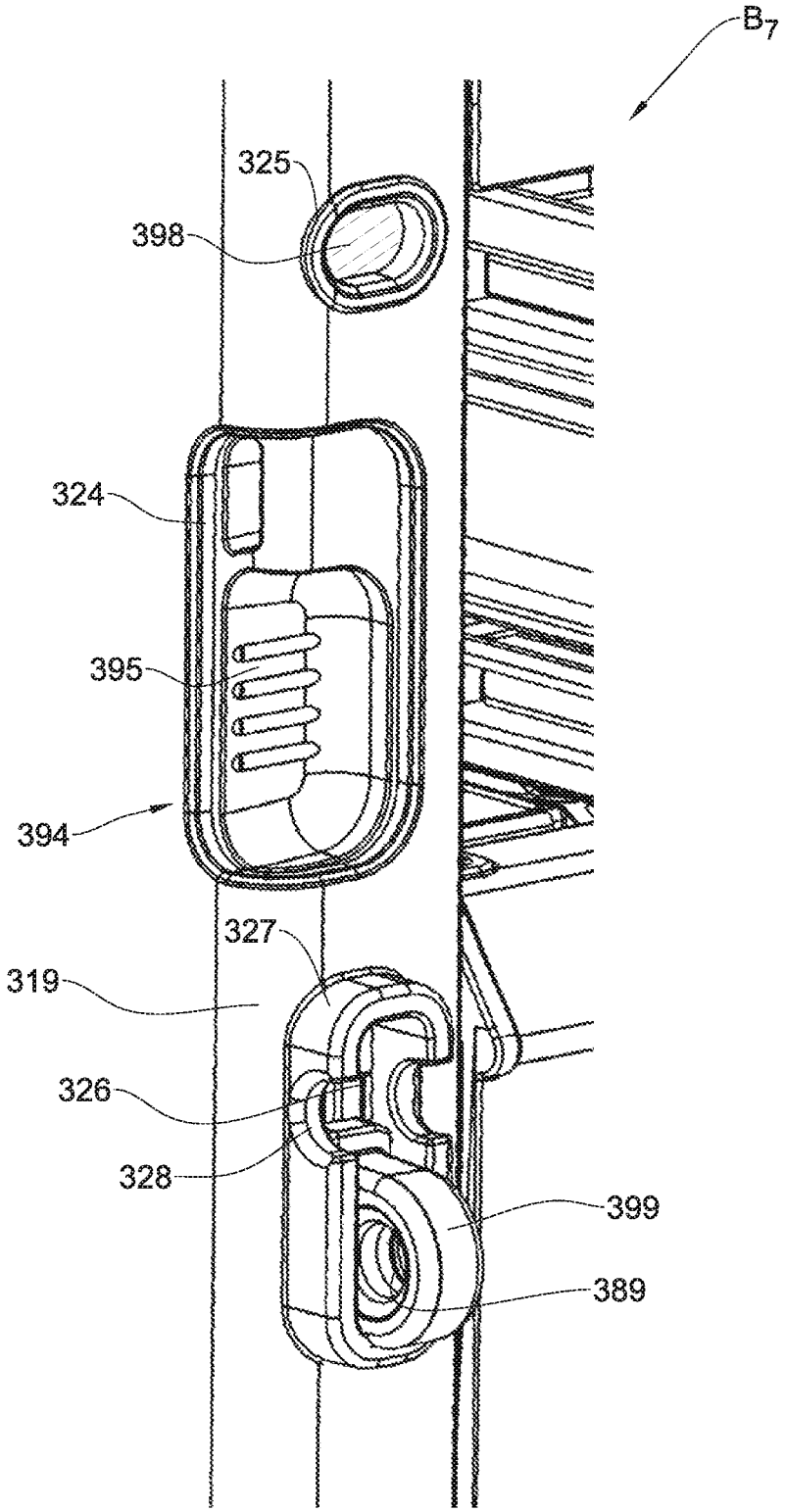
FIG. 17B is an enlarged view of a portion $B_7$ of FIG. 14A.

In FIG. 17A it is shown that the first portion 397 is visible via the indicating window 325, and in FIG. 17B it is shown that the second portion 398 is visible via the indicating window 325.

The locking mechanism 390 further includes a securing member 399 protruding therefrom and formed with a securing recess 389 therein. The right front edge 319 of the housing 310 is formed with an elongate opening 326 configured for receiving therethrough the securing member 399. The elongate opening 326 is formed with a raised rim 327 extending about the opening, and being formed with a locking recess 328.

As shown in FIG. 17A, in the locked state of the locking mechanism 390, the locking recess 328 is aligned with the securing recess 389, so that a shackle 309 of a lock 308 can be received through the locking recess 328 and the securing recess 389 so as to fix the locking mechanism 390 in its locked state.

As shown in FIG. 17B, in the unlocked state of the locking mechanism 390, the locking recess 28 is misaligned with the securing recess 389, so that the shackle 309 cannot be received within the locking recess 328 and the securing recess 389 at the same time because the rim 327 obstructs a portion of the securing recess 389. The In this position, the lock 308 cannot be used for fixing the locking mechanism in its unlocked state.

Reference is now made to FIGS. 18A to 24B, in which modular assembly 100 of cabinets illustrated, in accordance with another aspect of the presently disclosed subject matter.

The modular assembly 100 includes the cabinet 1, a cabinet 101 and a support structure 201 which are modularly stacked on each other, while the support structure 201 provides support to the whole assembly. In general, the modular assembly 100 can include more than two cabinets which can be modularly stacked on each other, while the lowermost cabinet is disposed on the support structure 201.

The cabinet 1 comprises the housing 10 and the two drawers 30 and 50. As described above with reference to FIG. 2E, the housing 10 has the following elements: the base section 12 with the base rim 13, the top section 14 with the top rim 15, the right sidewall 16, the left sidewall 18, the front frame 20 and the rear wall 22.

The housing 10 further comprises two upper latching mechanisms and two lower latching mechanisms. The upper latching mechanisms include a right upper latching mechanism (not seen) and a left upper latching mechanism 160, and the lower latching mechanisms include a right lower latching mechanism (not seen) and a left lower latching mechanism 170. The right upper latching mechanism of the housing 10 is formed within the right sidewall 16 and partially in the top rim 15. The left upper latching mechanism 160 is formed within the left sidewall 18 and partially in the top rim 15. The right lower latching mechanism of the housing 10 is formed within the right sidewall 16 and partially in the bottom rim 13. The left lower latching mechanism 170 is formed within the left sidewall 18 and partially in the bottom rim 13.

Figure 19:
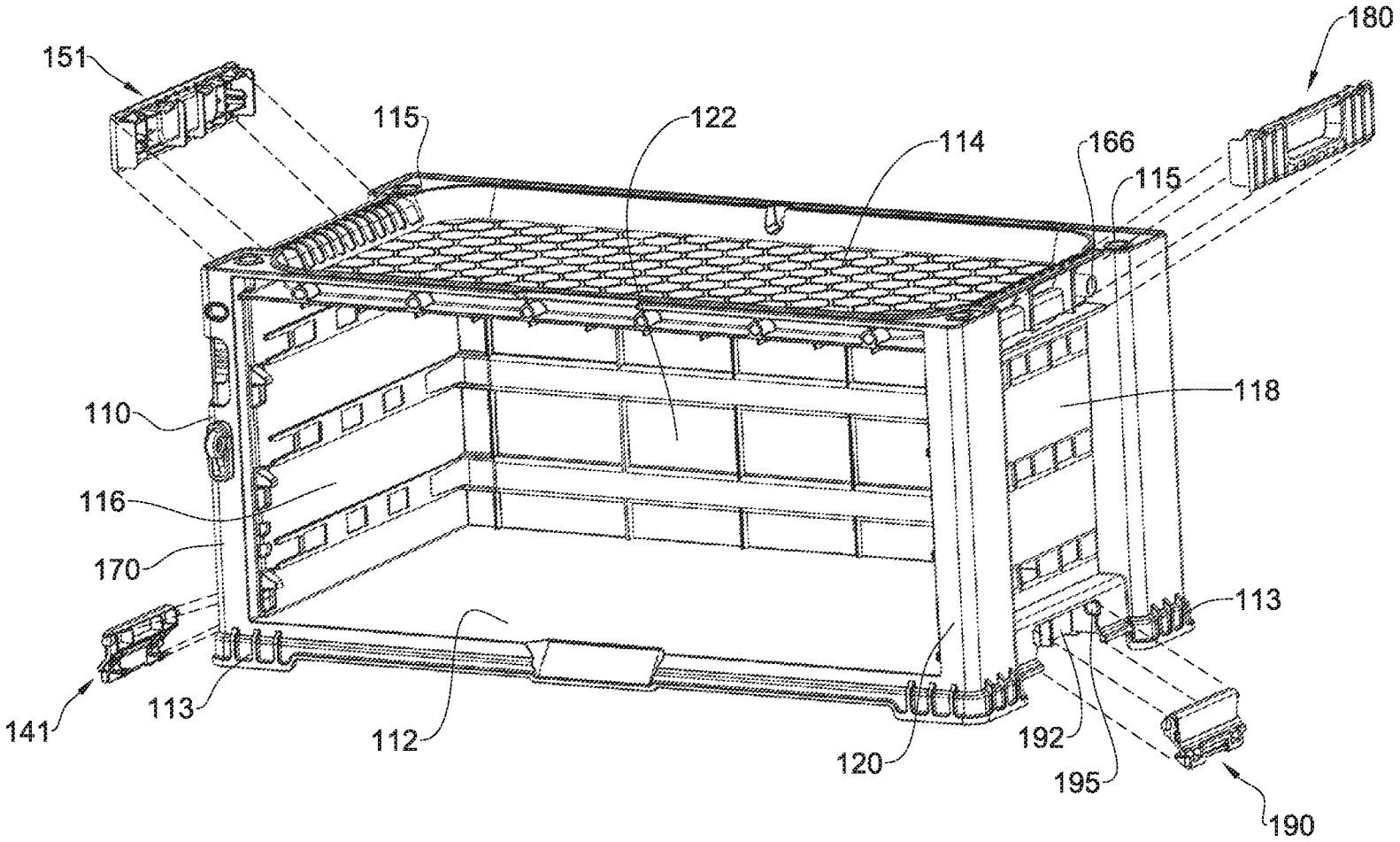
FIG. 19 is an exploded view of the housing of FIG. 2E.

The cabinet 101 comprises a housing 110 (shown in FIG. 19) which is similar in its structure to the housing 10, with three storage units in the form of drawers 130, 140 and 150 accommodated therein. As shown in FIG. 19, the housing 110 has a base section 112 with a base rim 113, a top section 114 with a top rim 115, a right sidewall 116, a left sidewall 118, a front frame 120 with an opening therein and a rear wall 122.

The housing 110 further comprises two upper latching mechanisms and two lower latching mechanisms. The upper latching mechanisms include a right upper latching mechanism 151 (shown in FIG. 19) and a left upper latching mechanism 180, and the lower latching mechanisms include a right upper mechanism 141 (shown in FIG. 19) and a left lower latching mechanism 190. The right upper latching mechanism of the housing 110 is formed within the right sidewall 116 and partially in the top rim 115. The left upper latching mechanism 180 is formed within the left sidewall 118 and partially in the top rim 115. The right lower latching mechanism of the housing 110 is formed within the right sidewall 116 and partially in the bottom rim 113. The left lower latching mechanism 190 is formed within the left sidewall 118 and partially in the bottom rim 113. When the cabinets 1 and 101 are stacked on each other, their front wall, rear wall and sidewalls are generally coplanar with each other.

Figure 18A:
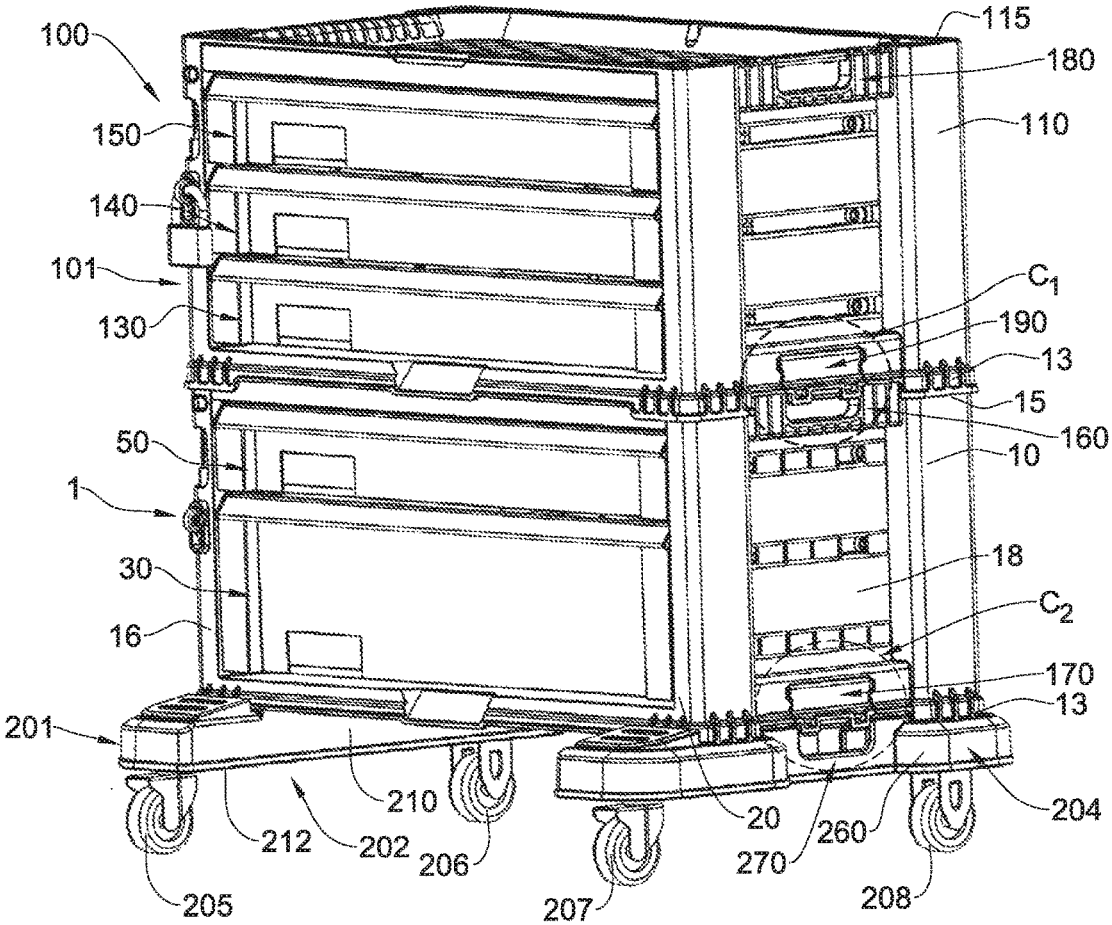
FIG. 18A is a front left isometric view of a modular assembly of cabinets, in accordance with another aspect of the presently disclosed subject matter.
Figure 22A:
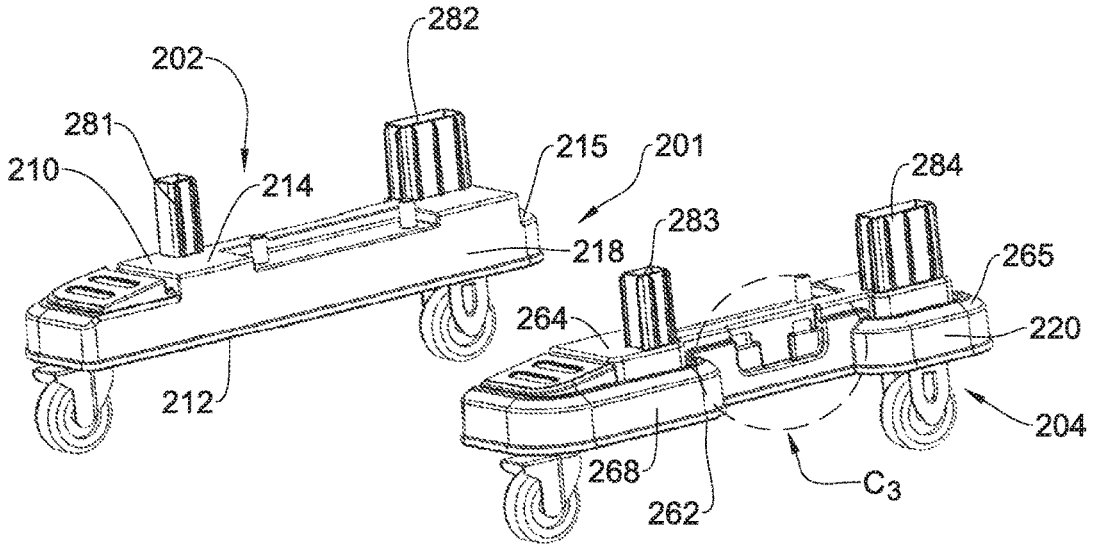
FIG. 22A is a front isometric view of a supporting structure of the assembly of FIG. 18A.

As shown in FIGS. 18A and 22A, the support structure 201 is constituted by two support members, including a right support member 202 and a left support member 204, each configured to be latched under its respective sidewall of the lowermost cabinet of the assembly. According to the present example, the lowermost cabinet is constituted by the cabinet 1.

The right support structure 202 has a housing 210 and the left support structure 204 has a housing 260. The housing 210 has a base section 212, a top section 214 with a top rim 215, a right sidewall (not seen) and a left sidewall 218. The housing 260 has a base section 262, a top section 264 with a top rim 265, a right sidewall (not seen) and a left sidewall 268.

The top section 214 has two support connecting portions 281 and 282 extending therefrom, and the top section 264 has two support connecting portions 283 and 284 extending therefrom. Each of the support connecting portions 281, 282, 283 and 284 is configured to be received within a corresponding cabinet connecting portion (not seen) formed within the bottom sections 12 and 112 for selectively disposing the cabinets 1 and 101 on the support structure 201.

The support connecting portions 281, 282, 283 and 284 are constituted by protruding element, and the cabinet connecting portions are constituted by corresponding recesses configured to receive the protruding elements.

The right support member 202 has two wheels 205 and 206 mounted to the base section 212, and the left support member 204 has two wheels 207 and 208 mounted to the base section 262. The wheels 205, 206, 207 and 208 are for allowing displacement of the assembly from place to place.

The support structure 201 includes two support latching mechanisms, including a right support latching mechanism (not seen) disposed in the right support member 202, and a left support latching mechanism 270 disposed in the left support member 204. The right support latching mechanism of the housing 210 is formed within the right sidewall of the housing 210 and partially in the top rim 215. The left support latching mechanism 270 is formed within the left sidewall 268 and partially in the top rim 265.

The modular assembly 100 of cabinets allows selectively stacking the cabinets 1 and 101 on each other and on the support structure 201 so that each one of the cabinets is latched to its neighboring cabinet by corresponding upper and lower latching mechanisms while the lowermost cabinet of the modular assembly is latched to the support structure by the corresponding lower latching mechanisms which is latched to the support latching mechanisms. In other words, the cabinets 1 and 101 can be stacked on top of each other such that in one configuration the cabinet 1 is disposed on the cabinet 101 and latched thereto, and in another configuration, the cabinet 101 is disposed on the cabinet 1 and latched thereto. In addition, the lowermost cabinet of the assembly can be latched to the support structure 201 by using the same latching mechanism of the lowermost cabinet which is used for latching this cabinet to another cabinet, as detailed below.

As shown in FIG. 18A, the base rim 113 of the cabinet 101 correspond in shape and size to the top rim 15 of the cabinet 1, so that the base rim 113 rests on the top rim 15. It should be indicated that the base rim 13 of the cabinet 1 corresponds in shape and size to the top rim 115 of the cabinet 101, so as to allow the cabinet 1 to be modularly stacked on the cabinet 101.

In addition, the base rim 13 correspond in shape and size to the support rim 265, so that the base rim 13 rests on the the support rim 265. It should be indicated that the base rim 113 also correspond in shape and size to the support rim 265, so as to allow the base rim 113 rests on the the support rim 265 when the cabinet 101 is disposed on the support structure 201.

As further shown in FIG. 18A, the left lower latching mechanism 190 of the cabinet 101 is latched to the left upper latching mechanism 160 of the cabinet 1, and the left lower latching mechanism 170 of the cabinet 1 is latched to the left support latching mechanism 270 of the support structure 201. Although it is not seen in FIG. 18A, the right lower latching mechanism 141 of the cabinet 101 is latched to the right upper latching mechanism of the cabinet 1, and the right lower latching mechanism of the cabinet 1 is latched to the right support latching mechanism of the support structure 201.

It is appreciated that the cabinets 1 and 101 can be replaced with each other, so that the cabinet 1 is stacked on the cabinet 101 and latched thereto, and the cabinet 101 is stacked on the support structure 201 and latched thereto by its right and left lower latching mechanisms of the cabinet 101 and the support latching mechanisms.

Figure 20A:
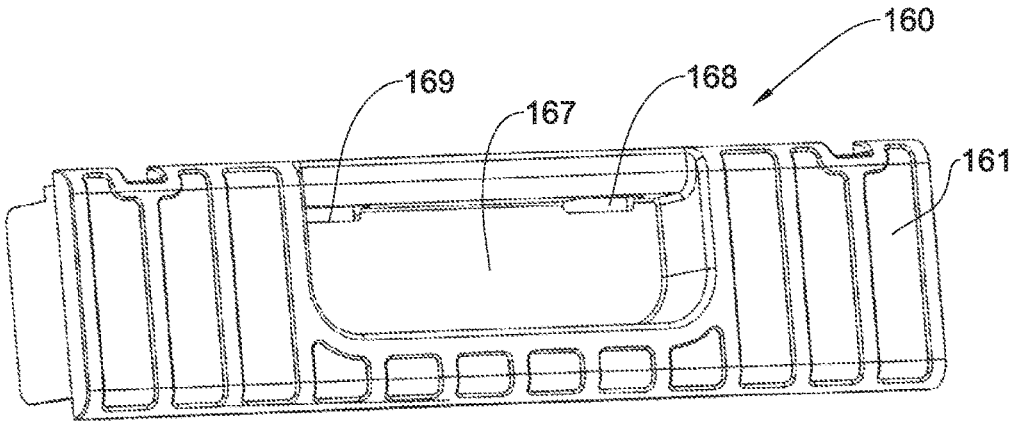
FIG. 20A is a front isometric view of an upper latching mechanism of the cabinets of FIG. 18A.
Figure 20B:
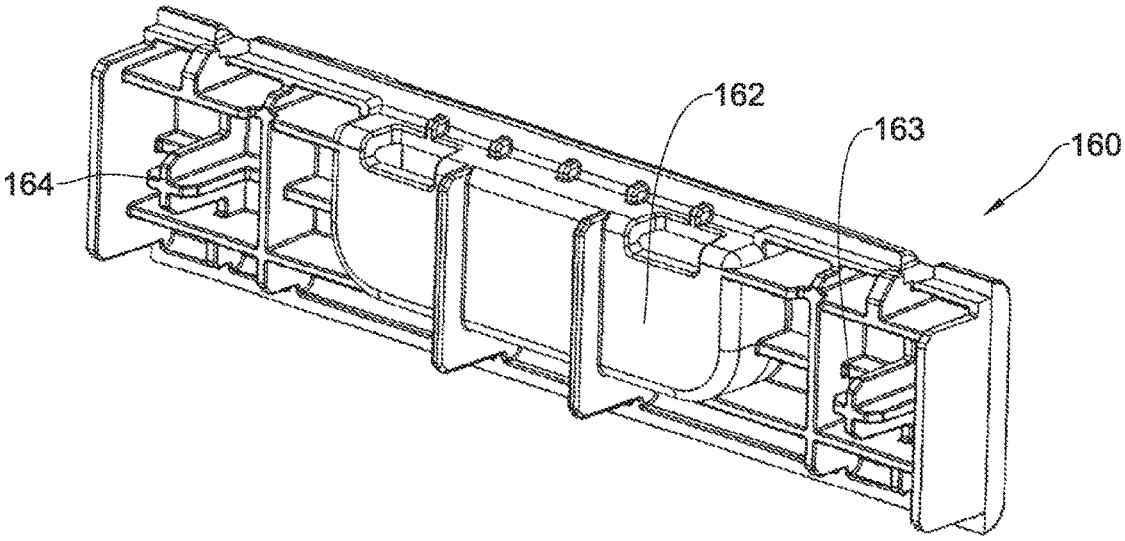
FIG. 20B is a rear isometric view of an upper latching mechanism of the cabinets of FIG. 18A.

Reference is now made to FIGS. 20A and 20B to describe the structure of the left upper latching mechanism 160, which is similar in its structure to the left upper latching mechanism 180 and to the right upper latching mechanisms of the cabinets 1 and 101. Due to this similarity, the description below with respect to left upper latching mechanism 160 is relevant to the other upper latching mechanisms as well.

The left upper latching mechanism 160 is a detachably attachable unit having a front surface 161 and a rear surface 162. The rear surface 162 includes two fixing members 163 and 164, each of which is configured to be received within its corresponding cavity within the left wall 118. One example of such a cavity is shown in FIG. 19, and designated as 166. The cavity 166 is configured for receiving a fixing member of the left upper latching mechanism 180. FIG. 19 illustrates the way in which the left upper latching mechanism 180 can be mounted to the left sidewall 118.

The front surface 161 has a recess 167 formed therein with two catch members 168 and 169, each configured for selectively engaging with a corresponding portion of the lower latching mechanism 190.

The right and the left upper latching mechanisms of the cabinets 1 and 101 can be further used as gripping members for allowing a user to grip the respective cabinet and raise it. In this case, the recess which is formed within the respective upper latching mechanism, such as the recess 167, can be used for accommodating the user's fingers when being gripped.

It should be indicated that the left and the right upper latching mechanisms are attachable to the cabinets 1 and 101 is a lateral direction, so as to support the weight of the cabinet when griped and raised by a user. The attachment in the lateral direction is provided by the direction of the fixing members 163 and 164 and their respective cavities, which is along the axis X. Since the axis X is perpendicular to the axis Y in which the cabinet is raised, the support to the weight of the cabinet is provided.

Figure 21A:
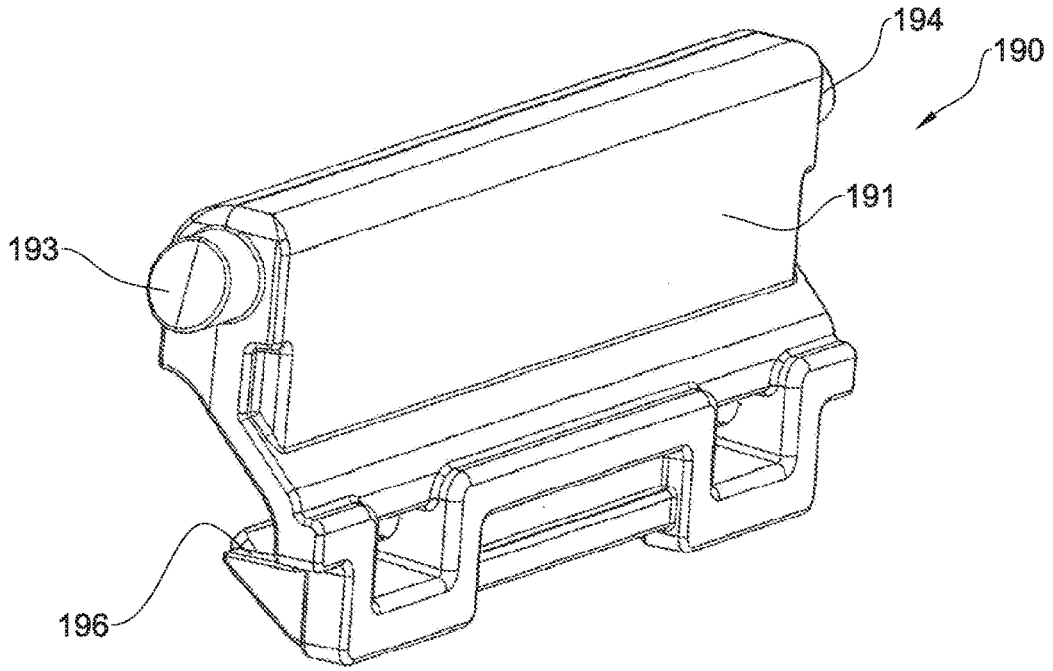
FIG. 21A is a front isometric view of a lower latching mechanism of the cabinets of FIG. 18A.
Figure 21B:
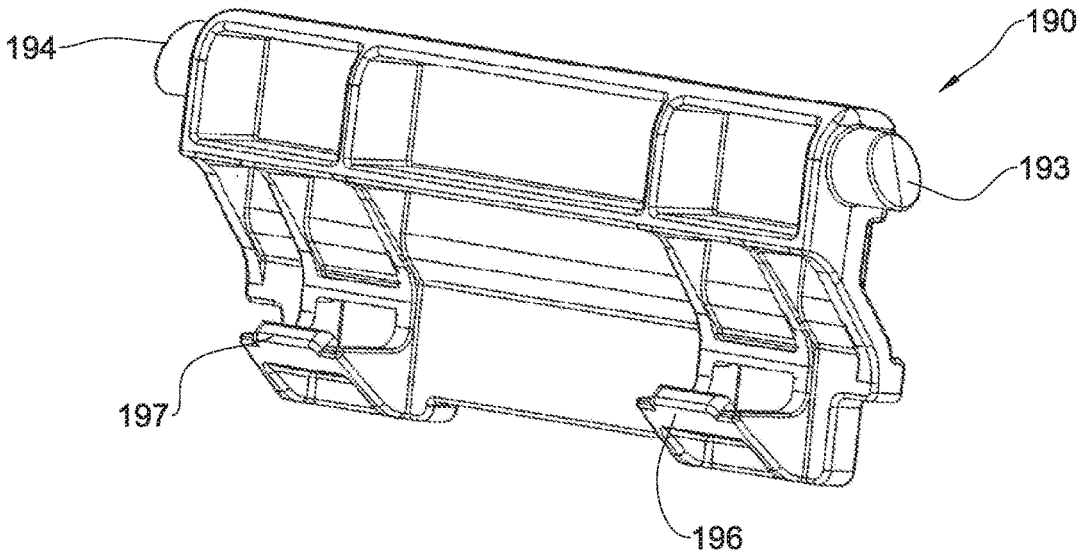
FIG. 21B is a rear isometric view of a lower latching mechanism of the cabinets of FIG. 18A.

Reference is now made to FIGS. 19, 21A and 21B to describe the structure of the left lower latching mechanism 190, which is similar in its structure to the left lower latching mechanism 170 and to the right lower latching mechanisms of the cabinets 1 and 101. Due to this similarity, the description below with respect to left lower latching mechanism 190 is relevant to the other lower latching mechanisms as well.

The left lower latching mechanism 190 is constituted by a latch member 191 (shown in FIGS. 21A and 21B), a latch recess 192 (shown in FIG. 19) formed within the sidewall 118. The latch member 191 is a pivotally rotatable member having two pivoting elements 193 and 194, disposed at the upper end of thereof. The pivoting elements 193 and 194 are configured to be received within corresponding cavities formed in the latch recess 192. One example of such a cavity is shown in FIG. 19, and designated as 195. When the latch member 191 is mounted within the latch recess 192, the pivoting element 194 is configured to be received in the cavity 195. The latch member 191 has two tongues 196 and 197 disposed at the lower end thereof. When the left lower latching mechanism 190 is engaged with the left upper latching mechanism 160, the latch member 191 is rotated towards the recess 167, so that the tongue 196 is received within the catch member 169, and the tongue 197 is received within the catch member 168, thereby latching the left lower latching mechanism 190 to the left upper latching mechanism 160.

Figure 22B:
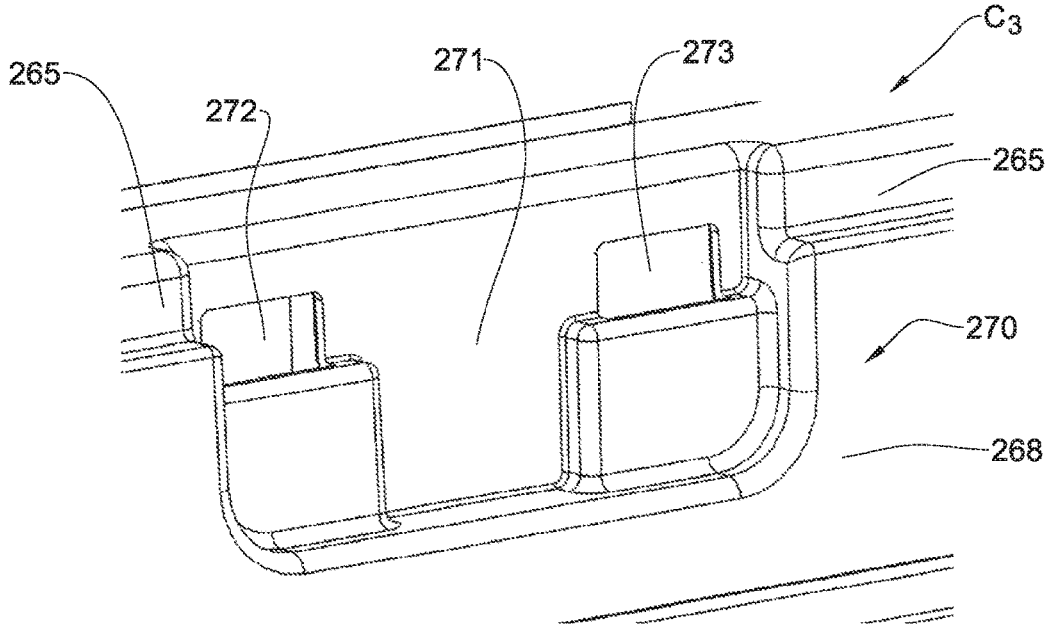
FIG. 22B is an enlarged view of a portion $C_3$ of FIG. 22A.

As shown in FIG. 22B, the left support latching mechanism 270 has a support recess 271 formed therein with two catch members 272 and 273, each configured for selectively engaging with a corresponding tongue of the left lower latching mechanism 170. According to another example, in which the cabinet 101 is the lowermost cabinet, the left lower latching mechanism 190 is engaged and latched with the left support latching mechanism 270 by the tongue 196 which is received within the catch member 272 and by the tongue 197 which is received within the catch member 273.

Figure 18B:
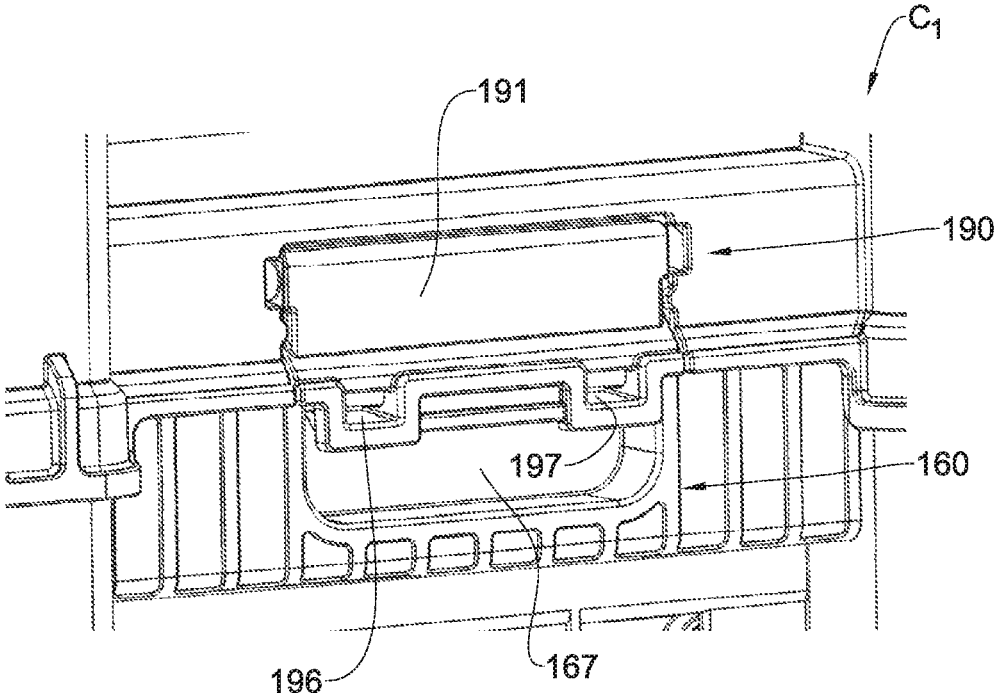
FIG. 18B is an enlarged view of a portion $C_1$ of FIG. 18A.
Figure 18C:
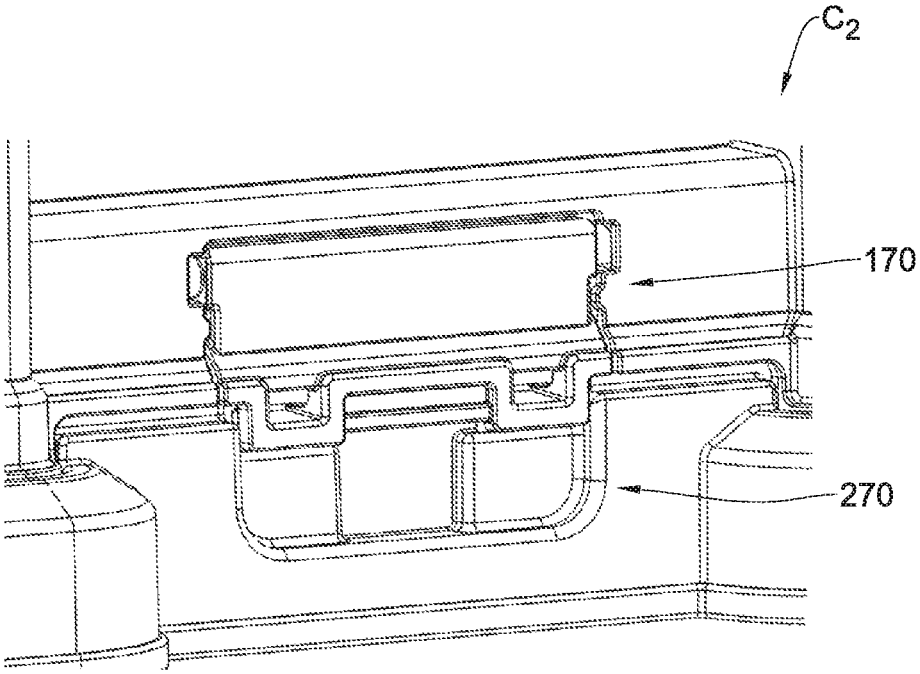
FIG. 18C is an enlarged view of a portion $C_2$ of FIG. 18A.

Turning now to FIGS. 18B and 18C, which summarizes the manner according to which the latching mechanisms of the left side of the modular assembly 100 are latched to each other. FIG. 18B illustrates the latching of the left lower latching mechanism 190 to the left upper latching mechanism 160. In this figure it is shown that the two tongues of the latch member 191 are received within their corresponding catch members. FIG. 18C illustrates the latching of the left lower latching mechanism 170 to the left support latching mechanism 270. In this figure it is shown that the two tongues of the latch member of the left lower latching mechanism 170 are received within their corresponding catch members 272 and 273.

Although not detailed above, the latching mechanisms of the right side of the modular assembly 100 are latched to each other in a similar manner at those of the left side.

Reference is now made particularly to FIGS. 23A to 24B, which illustrate another example of a cabinet 401. The cabinet 401 can be modularly integrated within the modular assembly of the presently disclosed subject matter, and in particular to be stacked above or below each one of the cabinets 1 and 101, or above the support structure 201. As part of the modular assembly, the cabinet 401 can also be stacked with another cabinet which is similar the cabinet 401.

The cabinet 401 comprises a housing 410 which is similar in its exterior structure to the housings 10 and 110 with three storage units in the form of assortment boxes 430, 440 and 450 accommodated therein. The housing 410 has a base section with a base rim 413, a top section 414 with a top rim 415, a right sidewall (not shown), a left sidewall 418, a front frame 420 with an opening therein and a rear wall 422.

The housing 410 further comprises two upper latching mechanisms and two lower latching mechanisms. The upper latching mechanisms include a right upper latching mechanism (not shown) and a left upper latching mechanism 480, and the lower latching mechanisms include a right upper mechanism (not shown) and a left lower latching mechanism 490. The right upper latching mechanism of the housing 410 is formed within the right sidewall and partially in the top rim 415. The left upper latching mechanism 480 is formed within the left sidewall 418 and partially in the top rim 415. The right lower latching mechanism of the housing 110 is formed within the right sidewall and partially in the bottom rim 413. The left lower latching mechanism 490 is formed within the left sidewall 418 and partially in the bottom rim 413.

For example, in order to connect the cabinet 401 to the cabinet 1, when the cabinet 401 is disposed on the cabinet 1, the right lower latching mechanism of the housing 410 has to be engaged with the right upper latching mechanism of the cabinet 1 and the left lower latching mechanism 490 has to be engaged with the left upper latching mechanism 160 of the cabinet 1.

Figure 23A:
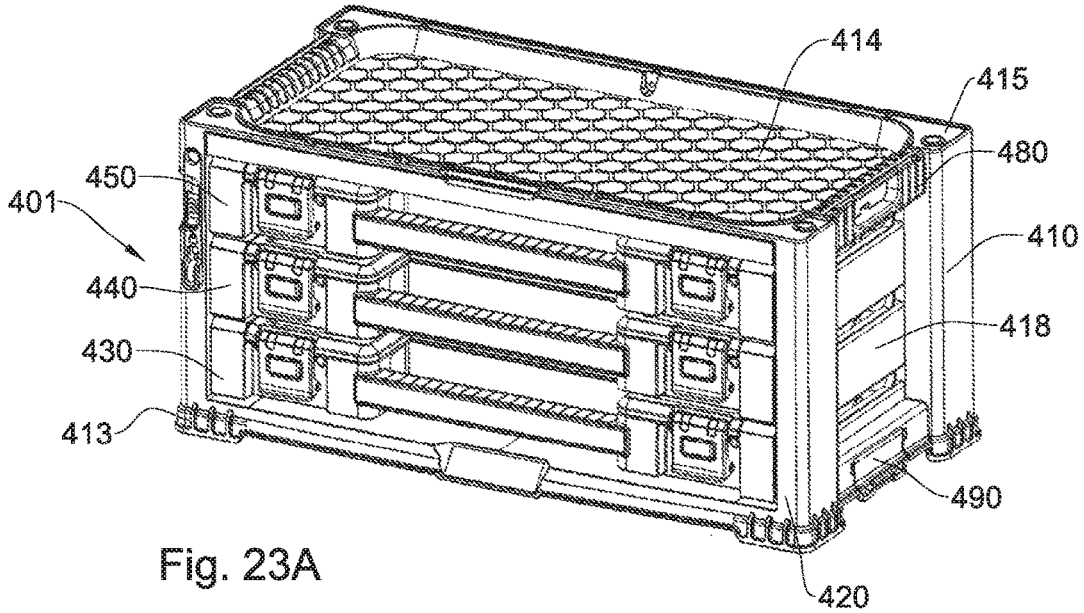
FIGS. 23A and 23B are an isometric view of a cabinet of assortment boxes.
Figure 23B:
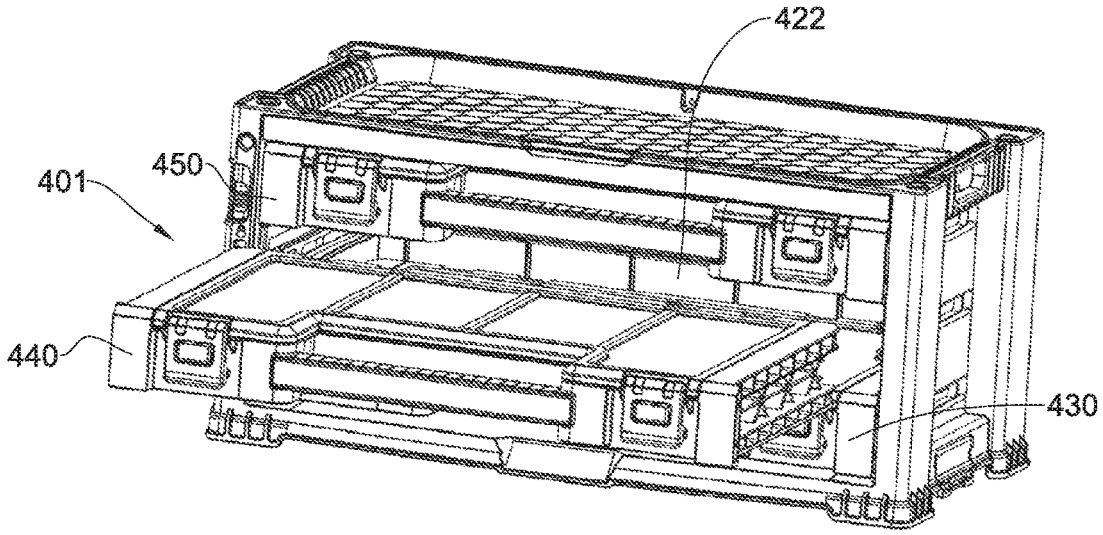

The assortment boxes 430, 440 and 450 are configured to be inserted into and extracted from the housing 410. As shown in FIG. 23B, the assortment box 430 is extracted from the housing 410.

Figure 24A:
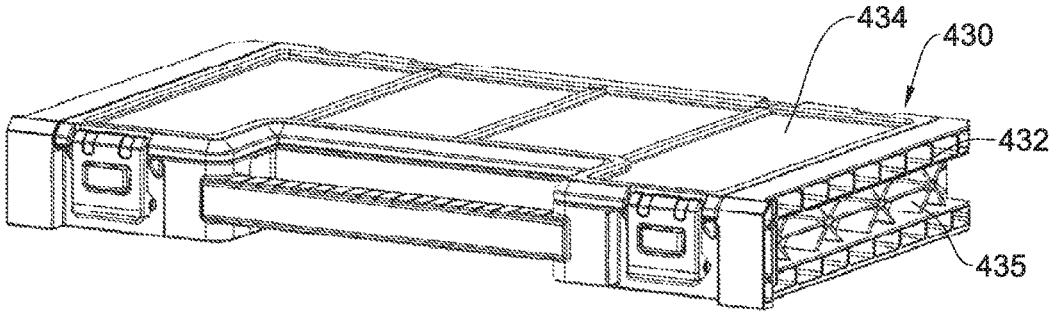
FIGS. 24A and 24B are an isometric view of an assortment box of the cabinet of FIGS. 23A and 23B.
Figure 24B:
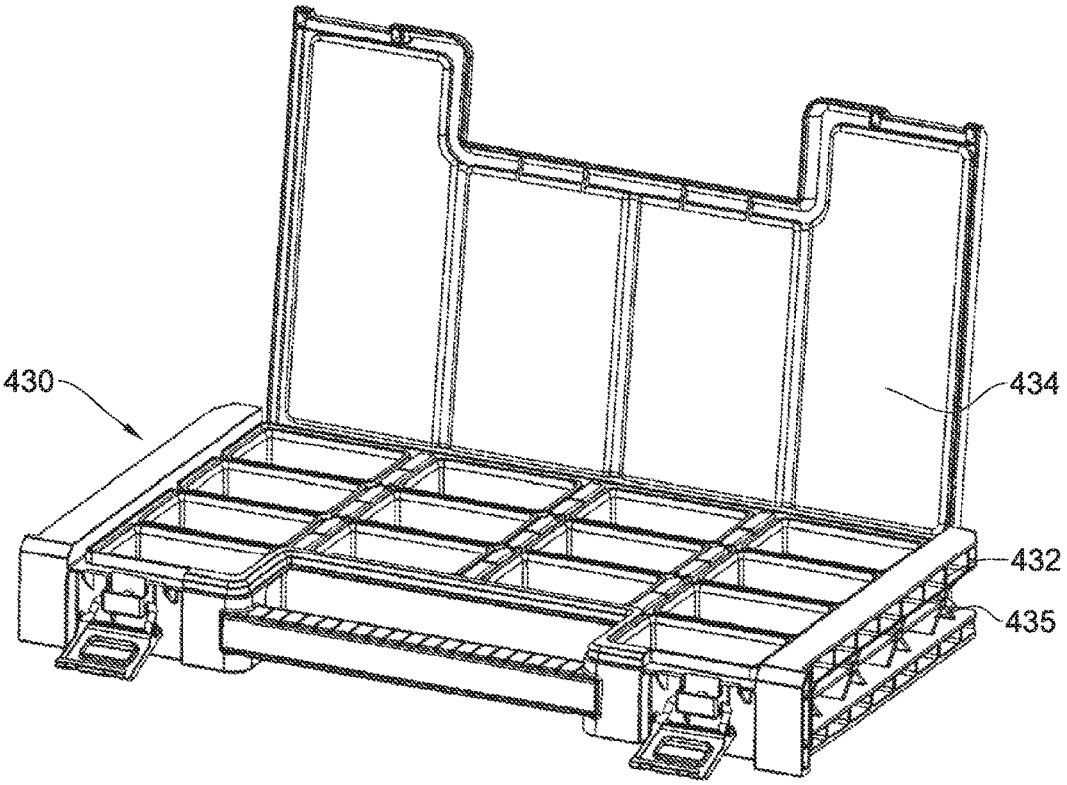

Reference is now made to FIGS. 24A and 24B, in which the assortment box 430 is illustrated. As shown in these figures, the assortment box 430 has an assortment box housing 432 and a cover 434 pivotally articulated thereto. The assortment box 430 is convertible between a closed position in which the cover 434 covers the assortment box housing 432 (shown in FIG. 24A) and an open position shown in FIG. 24B in which the cover 434 provides access to the interior of the assortment box housing 432. The housing 434 has a right rail (now shown) and a left rail 435 in form of a recess, which is configured to receive a corresponding elongated protruding member of the housing 410 so as to allow the assortment box 430 to slide within the housing 410.

The invention claimed is:

1. A cabinet, comprising:

a housing;

two or more storage units, the storage units accommodated within the housing and displaceable between a closed position in which the storage units are disposed within the housing and an open position in which at least one of the storage units projects from the housing to an extent greater than in the closed position, each of the storage units comprising a guiding portion and a restricting arrangement; and a blocking mechanism, the blocking mechanism comprising an integrally molded member integrally formed with two or more blocking-following members and a longitudinal body, each of the blocking-following members comprises one of two or more blocking members and one of two or more following members, each of said blocking-following members is formed on an L-shaped arm of the blocking mechanism, each said L-shaped arm comprising a long section generally parallel to a vertical axis of the housing and a short section generally normal to the long section, each long section extending from the longitudinal body, each blocking-following member disposed on one of the short sections;

wherein the blocking mechanism is displaceable between an unblocked state in which each of the storage units is free to be displaced from the closed position to the open position and a blocked state in which all but one of the storage units are arrested in the closed position, each of the storage units is arrested in the closed position by a corresponding one of the blocking members obstructing the restricting arrangement of said storage unit while the blocking mechanism is in the blocked state;

wherein when the blocking mechanism is in the unblocked state, displacement of one of the storage units from the closed position to the open position induces displacement of the blocking mechanism from the unblocked state to the blocked state;

wherein when the blocking mechanism is in the blocked state, displacement of one of the storage units from the open position to the closed position induces displacement of the blocking mechanism from the blocked state to the unblocked state; and wherein each following member of the blocking-following members engages the guiding portion of one of the storage units during all steps of displacement of the one of the storage units from the closed position to the open position and during displacement of the one of the storage units from the open position to the closed position.

2. The cabinet according to claim 1, wherein the restricting arrangement is constituted by restricting portions on the storage units, so that in the blocked state, corresponding ones of the blocking members are aligned with the restricting portions of corresponding ones of the storage units so that during an attempt to displace one of the corresponding ones of the storage units from the closed position to the open position, the corresponding ones of the blocking members are configured to engage the restricting portions of the restricting arrangement of the corresponding ones of the storage units to thereby obstruct and prevent displacement thereof.

3. The cabinet according to claim 1, wherein the following members form a following arrangement, the following arrangement being associated with the storage units such that displacement of one of the storage units from the closed position to the open position entails displacement of the following arrangement from an inoperative state to an operative state, and the following arrangement being associated with the blocking mechanism such that displacement of the following arrangement from the inoperative state to the operative state entails displacement of the blocking mechanism from the unblocked state to the blocked state.

4. The cabinet according to claim 3, wherein the guiding portion associated with the following member of each of the storage units is configured, so that during the displacement of the storage unit between the closed position and the open position, the following member slidingly engages the guiding portion, thereby changing the following arrangement between the inoperative state and the operative state, respectively.

5. The cabinet according to claim 1, wherein the storage units are arranged within the cabinet along the vertical axis of the housing, and the longitudinal body of the blocking mechanism extends along the vertical axis, and wherein the blocking mechanism is configured to be displaced between the blocked state and the unblocked state along the vertical axis.

6. The cabinet according to claim 1, wherein the blocking mechanism is normally urged into the unblocked state by gravity.

* * * * *